US007154489B2

(12) United States Patent
Abe et al.

(10) Patent No.: US 7,154,489 B2
(45) Date of Patent: Dec. 26, 2006

(54) DRIVE CONTROL APPARATUS AND DRIVE CONTROL METHOD FOR DISPLAY PANEL

(75) Inventors: Naoto Abe, Tokyo (JP); Osamu Sagano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 510 days.

(21) Appl. No.: 10/767,733

(22) Filed: Jan. 30, 2004

(65) Prior Publication Data

US 2005/0001827 A1 Jan. 6, 2005

(30) Foreign Application Priority Data

May 16, 2003 (JP) ..... 2003-139501

(51) Int. Cl.
*G09G 5/00* (2006.01)

(52) U.S. Cl. ..... 345/204; 345/94; 345/100

(58) Field of Classification Search ..... 345/76–90, 345/92–96, 98–101, 211–214, 690, 204
See application file for complete search history.

(56) References Cited

U.S. PATENT DOCUMENTS

| | | | | |
|---|---|---|---|---|
| 5,631,920 | A | 5/1997 | Hardin | 375/200 |
| 5,659,339 | A | 8/1997 | Rindal et al. | 345/212 |
| 5,736,893 | A | 4/1998 | Puckette et al. | 327/551 |
| 5,909,144 | A | 6/1999 | Puckette et al. | 327/551 |
| 6,985,141 | B1 * | 1/2006 | Abe et al. | 345/204 |
| 7,009,627 | B1 * | 3/2006 | Abe et al. | 345/690 |
| 2002/0195966 | A1 | 12/2002 | Aoki et al. | 315/169.3 |
| 2003/0030654 | A1 | 2/2003 | Sagano et al. | 345/660 |

FOREIGN PATENT DOCUMENTS

| | | |
|---|---|---|
| EP | 1 267 319 A2 | 12/2002 |
| JP | 57-150890 | 9/1982 |
| JP | 63-071889 | 4/1988 |
| JP | 3-062094 | 3/1991 |
| JP | 8-320665 | 12/1996 |
| JP | 9-98152 | 4/1997 |
| JP | 9-232944 | 9/1997 |
| JP | 9-289527 | 11/1997 |
| JP | 10-39825 | 2/1998 |

OTHER PUBLICATIONS

U.S. Appl. No. 09/512,105 filed Feb. 24, 2000, Mori et al.
U.S. Appl. No. 10/788,282 filed Mar. 1, 2004, Ikeda et al.

* cited by examiner

*Primary Examiner*—Richard Hjerpe
*Assistant Examiner*—Mansour M. Said
(74) *Attorney, Agent, or Firm*—Fitzpatrick, Cella, Harper and Scinto

(57) ABSTRACT

A modulation clock supplied to a drive circuit (7) of a display panel (1) is frequency-modulated so as to spread its harmonics spectrum. The frequency deviation is so restricted that, if at least two pixels corresponding to two adjacent scanning wirings are displayed based on arbitrary same luminance data, a difference in display luminance in a specified period between one pixel and the other pixel is less than or equal to a tolerable value determined by the luminance data. Consequently, reduction in unnecessary radiation can be achieved at a lower cost while suppressing deterioration in image quality

36 Claims, 26 Drawing Sheets

DRIVE CONTROL APPARATUS AND DRIVE CONTROL METHOD FOR DISPLAY PANEL

BACKGROUND OF THE INVENTION

1. Field of the Invention

The present invention relates to a drive control apparatus and drive control method for a display panel for displaying an image signal outputted from a computer, TV image signal or the like.

2. Description of the Related Art

Conventionally, as a method for reducing electromagnetic interference (EMI), for example, patent document 1 (Japanese Patent Application Laid-Open (JP-A) No. 8-320665), patent document 2 (JP-A No. 9-98152), patent document 3 (JP-A No. 9-232944) and patent document 4 (JP-A No. 9-289527) have been proposed.

According to the above-mentioned conventional EMI reduction method, a system clock is frequency-modulated so as to spread the spectrum of harmonics of the system clock thereby to reduce EMI spectrum amplitude which is measured in a relatively wide band.

According to the patent document 1, when digital data is transferred to a flat panel display, the phase of the data and its data transfer clock is changed over so as to reduce the EMI accompanied by the data transfer.

The patent document 2 has disclosed that a reference frequency clock is frequency-modulated and converted to an output of a spread spectrum generating apparatus. Further, a specific frequency modulation method has been explained. Additionally, this document has disclosed that deterioration level is low if each sweep to a laser beam printer or a video display for scanning synchronizes with a same point in spread spectrum.

The patent document 3 has described a method for frequency-modulating an output clock (system clock) digitally from its source clock.

The patent document 4 has disclosed a method for frequency-modulating a base signal to generate a modulated clock reference signal which is a system clock for reducing the EMI. Regarding the synchronizing signal of a display unit, this document has disclosed that the frequency of a modulated waveform is matched with the horizontal retrace period of the display unit in order to suppress a deviation of a horizontal position displayed on each scanning line.

The above-mentioned patent documents have disclosed a method for damping harmonics of the system clock of an electronic apparatus, a method for damping harmonics of data transfer, particularly, a modulation method for frequency-modulating the system clock.

However, it has been found that even if the phase of data transfer clock is changed over, some kind of unnecessary radiation critical for the EMI, which is emitted from the display panel, cannot be suppressed. This will be described in detail below.

The drive control method for the display panel includes some kinds of luminance modulation methods for determining the display luminance (gradation level) for a single pixel. The first method of them is a method for modulating the amplitude of a voltage applied to a modulation device of pixel and the second method is a method for modulating the quantity of current to be supplied to the modulation device of pixel. Additionally, other method is available for controlling based on the length of light emission period in a selecting period of that pixel and still other method is also available in which the former method is combined with the method of modulating voltage or current. These methods are called pulse width modulation method.

According to the pulse width modulation method, modulation clock (PCLK) dedicated for luminance modulation is prepared separately from data transfer clock. At least the pulse width of a modulation signal waveform is determined synchronously with this modulation clock.

It has been found that when the unnecessary radiation (EMI) of an image display unit is measured by driving a matrix panel which is a display panel according to this pulse width modulation method, the level of harmonics component of the modulation clock (PCLK) may exceed a legal standard value, for example, class B provided by voluntary control council for interference by information technology equipment (VCCI).

The modulation clock (PCLK) is determined based on the length of a time (selecting time) for selecting a row wiring, the quantity of gradations to be displayed, modulation method and the like, and as described later, it is set to near 10 MHz, at least about several MHz—40 MHz. If the screen size of matrix panel is about 40-inch 16:9, the length of the modulation wiring is about 0.5 m and if the capacity between the wires is considered, there is a possibility that resonance may occur at several hundreds MHz. Further, the harmonics component decreases gradually as the order of the harmonics increases with respect to the basic wave as estimated from Fourier transformation of rectangular wave. The unnecessary radiation emitted as a result is expanded from several tens MHz which is harmonics component of the modulation clock (PCLK) up to several hundreds MHz. Actually, various factors such as frequency of the modulation clock (PCLK) and the screen size of the matrix panel are related to the unnecessary radiation and in the matrix panel image display unit which the inventor of the present invention and others measured on, harmonic components of the modulation clock (PCLK) from 100 MHz to 400 MHz are largely detected.

Further, most of the detected harmonic components is refrained from being detected if a drive circuit which receives an input of luminance data and modulated clock so as to output a modulation signal to the matrix panel is separated from the matrix panel. An influence of the unnecessary radiation from the matrix panel originated from data transfer clock is very small as compared to that of the unnecessary radiation by the modulation clock and this is not so serious as that of the modulation clock.

That is, according to knowledge of the present inventor, it has been found that the unnecessary radiation emitted from the matrix panel cannot be eliminated sufficiently even if the data transfer clock or system clock is subjected to frequency modulation like the conventional EMI countermeasure.

The EMI emitted from the display panel can be reduced by shielding an entire case including the display panel with a conductive member. Although general electronic apparatus can be shielded with a metallic member or the like, the display portion on the front face of the matrix panel in an image display unit needs to be shielded with a member having a high electric conductivity which does not sacrifice its optical characteristic (that is, colorless transparent). However, the member having a high electric conductivity which does not sacrifice the optical characteristic is expensive.

Thus, the inventor has considered a method for reducing the harmonic component of the modulation clock (PCLK) by adding such a member as ferrite core for removing the harmonic component between the output of a modulator (drive circuit) and the modulation wiring. However, in case where the screen size of the matrix panel is 40 inch 16:9, adding ferrite cores to each of several thousands modulation wiring connected in a width of about 1 m is actually difficult from viewpoints of their mounting and boosts manufacturing cost. For this reason, this method is difficult to adopt to the image display unit of a TV unit which is a civilian product for commercial reasons.

SUMMARY OF THE INVENTION

An object of the present invention is to provide a display panel drive control technique capable of reducing unnecessary radiation from a display panel at a lower cost while suppressing deterioration in image quality so as to display gradations excellently by pulse width modulation.

To achieve the above object, according to a first aspect of the present invention, there is provided a drive control apparatus for a display panel comprising: a drive circuit for supplying a modulation signal to a modulation wiring of the display panel, having a modulator for generating the modulation signal in which at least a pulse width thereof is modulated based on inputted luminance data; a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, the modulation clock supplying circuit supplies the modulation clock which has a frequency deviation to spread harmonics spectrum as compared to a virtual source clock of a constant frequency, and the frequency deviation is so restricted that, if at least two pixels corresponding to two adjacent scanning wirings are displayed based on arbitrary same luminance data, a difference between a display luminance (display brightness, display intensity) of one pixel in a specified period and a display luminance of the other pixel in the specified period is less than or equal to a tolerable value determined by the luminance data.

According to a second aspect of the present invention, there is provided a drive control apparatus for a display panel comprising: a drive circuit for supplying a modulation signal to a modulation wiring of the display panel, having a modulator for generating the modulation signal in which at least a pulse width thereof is modulated based on inputted luminance data; a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, the modulation clock supplying circuit supplies the modulation clock which has a frequency deviation to spread harmonics spectrum as compared to a virtual source clock of a constant frequency, and the frequency deviation is so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data.

According to a third aspect of the present invention, there is provided a drive control apparatus for a display panel comprising a drive circuit for supplying a modulation signal to a modulation wiring of the display panel, having a modulator for generating the modulation signal in which at least a pulse width thereof is modulated based on inputted luminance data; a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, and the modulation clock supplying circuit supplies the modulation clock which has a frequency deviation to spread harmonics spectrum as compared to a virtual source clock of a constant frequency and includes a gradation converter for converting a gradation of the luminance data in order to compensate for changes in a display luminance level due to the frequency deviation.

Preferably, in the drive control apparatus according to the third aspect of the invention, the frequency deviation is so restricted that, if at least two pixels corresponding to two adjacent scanning wirings are displayed based on arbitrary same luminance data, a difference between a display luminance of one pixel in a specified period and a display luminance of the other pixel in the specified period is less than or equal to a tolerable value determined by the luminance data.

Preferably, in the drive control apparatus according to the third aspect of the invention, the frequency deviation is so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data.

Preferably, the display luminance of the specified period is a luminance in a single frame period or an average luminance of two or more frame periods.

Preferably, a phase of the modulation clock is changed in synchronization with a selection period of the scanning wiring.

Preferably, the modulation clock is so constructed that differential values of its periods are continuous.

Preferably, the tolerable value is 10% the maximum display luminance.

Preferably, when the display luminance in the specified period of the one pixel is La, the display luminance in the specified period of the other pixel is Lb and the difference in luminance is $|La-Lb|$, the tolerable value is 0.015 (La+Lb).

Preferably, the tolerable value is a difference between display luminances displayed based on the luminance data of adjacent two levels.

Preferably, the tolerable value is small when the luminance data is small and large when the luminance data is large.

Preferably, the tolerable value is a quantity proportional to the power of the luminance data.

According to a fourth aspect of the present invention, there is provided a drive control method for a display panel comprising the steps of: generating a modulation clock which serves as a criterion for determining a pulse width of a modulation signal and has a frequency deviation to spread harmonics spectrum as compared to a virtual source clock of a constant frequency, the frequency deviation being so restricted that, if at least two pixels corresponding to two adjacent scanning wirings are displayed based on arbitrary same luminance data, a difference between a display luminance of one pixel in a specified period and a display luminance of the other pixel in the specified period is less than or equal to a tolerable value determined by the luminance data; generating a modulation signal by modulating at least a pulse width based on inputted luminance data in synchronization with the modulation clock; selecting a scanning wiring of the display panel; and supplying the modulation signal to a modulation wiring of the display panel.

According to a fifth aspect of the present invention, there is provided a drive control method for a display panel comprising the steps of: generating a modulation clock which serves as a criterion for determining a pulse width of a modulation signal and has a frequency deviation to spread harmonics spectrum as compared to a virtual source clock of a constant frequency, the frequency deviation being so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data; generating a modulation signal by modulating at least a pulse width based on inputted luminance data in synchronization with the modulation clock; selecting a scanning wiring of the display panel; and supplying the modulation signal to a modulation wiring of the display panel.

According to a sixth aspect of the present invention, there is provided a drive control method for a display panel comprising the steps of: generating a modulation clock which serves as a criterion for determining a pulse width of a modulation signal and has a frequency deviation to spread harmonics spectrum as compared to a virtual source clock of a constant frequency; converting a gradation of luminance data in order to compensate for changes in a display luminance level due to the frequency deviation; generating a modulation signal by modulating at least a pulse width based on inputted luminance data in synchronization with the modulation clock; selecting a scanning wiring of the display panel; and supplying the modulation signal to a modulation wiring of the display panel.

Because according to the present invention, the modulation clock for the pulse width modulation is frequency-modulated while maintaining a high image quality, the unnecessary radiation from the display panel can be reduced. Therefore, members having a high electric conductivity, which is necessary conventionally for reducing the unnecessary radiation and does not sacrifice the optical characteristic of an image display unit, and other members such as ferrite, which are attached between an output of a modulator and modulation wiring in order to remove harmonic components become unnecessary. Consequently, according to the present invention, the reduction in unnecessary radiation can be achieved at a lower cost.

DESCRIPTION OF THE PREFERRED EMBODIMENTS (First Embodiment)

(Composition)

First, the basic operation about the drive method of the matrix panel of the first embodiment will be described.

Figure 1:
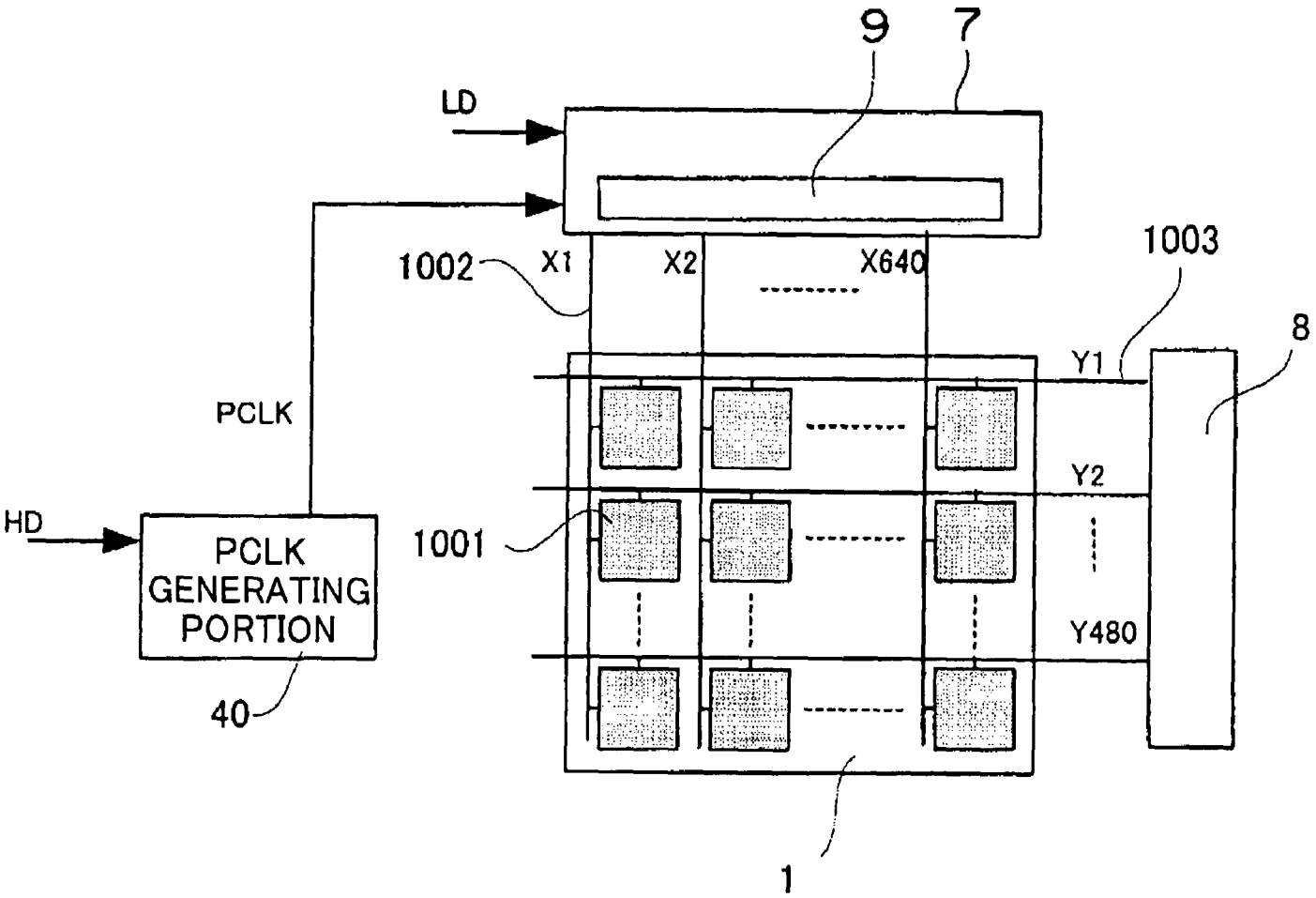
FIG. 1 is a diagram showing the first embodiment of the present invention.

FIG. 1 shows a matrix panel having matrix wiring of 480 rows·640×3 (RGB) columns.

A pixel 1001 of a matrix panel (display panel) 1 is constructed containing a modulation device such as a cold cathode device and the modulation device is formed on a substrate like glass. In case of a display matrix panel using the cold cathode device, a substrate (not shown) like glass which is coated with fluorescent material and a high voltage is applied on is provided so as to oppose the pixel 1001 so that the fluorescent material emits light due to electrons emitted from the cold cathode device.

Reference numeral 1002 denotes column wiring (modulation wiring) and reference numeral 1003 denotes row wiring (scanning wiring). A physical intersection between the column wiring 1002 and the row wiring 1003 is insulated and a cold cathode device constituting the pixel 1001 is connected to the electric circuit intersection of the matrix wiring.

In the structure shown in FIG. 1, at least one row wiring 1003 is selected successively corresponding to a horizontal synchronizing signal of an image signal containing luminance data to be inputted and a predetermined selective potential is applied from a row selecting circuit (selecting circuit) 8 in its selecting period. On the other hand, a modulation signal corresponding to luminance data of the selected row wiring is applied to the column wiring 1002 from a column drive circuit (drive circuit) 7 in the selecting period. This selection is carried out for all rows so as to terminate a single vertical scanning period so that an image of a screen is formed. The modulation signal corresponding to luminance data determines a pulse width with reference to the modulation clock (PCLK) generated by a PCLK generating portion 40 as described later. If the modulation clock (PCLK) is common to each column, the quantity of wires is small thereby to reduce cost, which is preferable. The column drive circuit 7 is provided with a modulator 9 capable of changing (modulating) at least the pulse width based on the luminance data of each column wiring in synchronization with the modulation clock (PCLK). Here, the PCLK generating portion 40 corresponds to a modulation clock supplying circuit.

If a matrix panel of 480 rows·640×3 (RGB) columns as shown in FIG. 1 is displayed according to a standard TV signal like NTSC system, preferably, each selecting time is determined to be 1/525 a frame time of a signal to be inputted. The standard TV signal like the NTSC system is converted to 525P signal by an interlace progressive converter (not shown). The converted 525P signal is inputted so that the matrix panel displays an image as follow. A selecting potential is supplied to the row wiring 1003 successively in unit time of 1/525 a frame time of an image signal to be inputted. Then, a modulation signal corresponding to each scanning line is given to the column wiring 1002, so as to display an image corresponding to each scanning line. If the selecting potential is supplied to the row wiring from the first row to the 480 row, an image of a frame is formed.

Next, the modulation signal to be inputted to the column wiring will be described. According to the first embodiment, the modulation method is pulse width modulation (PWM). That is, a pulse is outputted until a count value of the modulation clock (PCLK) becomes equal to the value of luminance data of a corresponding column wiring.

Figure 2:
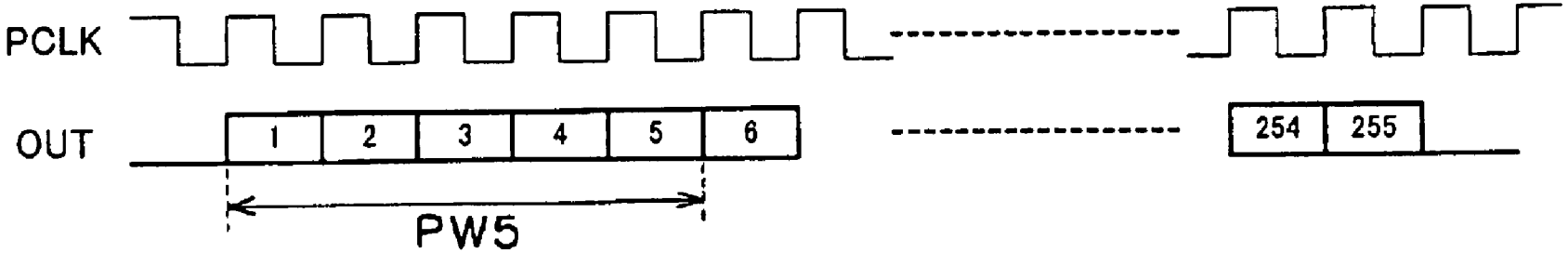
FIG. 2 is a diagram showing an example of pulse width modulation signal waveform and modulation clock (PCLK)

FIG. 2 shows an example of outputted modulation signal waveform and modulation clock (PCLK).

In FIG. 2, a number (1–255) in unit waveforms (rectangle) of the modulation signal means luminance data. For example when the luminance data is "5", five high-level unit waveforms of times in which the numbers in the rectangle correspond to "1"–"55" are outputted continuously as the modulation signal and low-level arises in a subsequent time so that no unit waveform is outputted. That is, in this case, the pulse width of a pulse width modulated modulation signal is code PW5. The quantity of supplied unit waveforms can be controlled according to a digital signal. This unit waveform is called time slot depending on the case.

Figure 3:
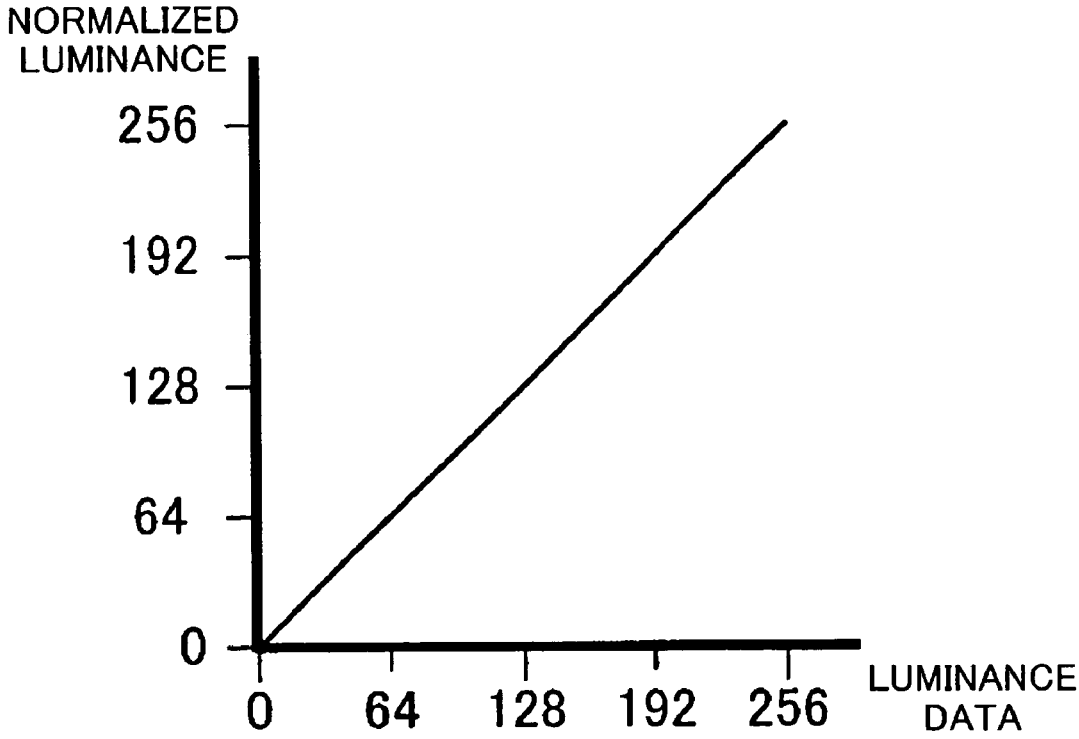
FIG. 3 is a diagram showing the characteristic of luminance to luminance data.

FIG. 3 shows the characteristic of display luminance of a pixel to luminance data to be inputted. Here, the display luminance is expressed in normalization form. Although the luminance data of the abscissa axis and display luminance of the ordinate axis are discrete actually, the characteristic is represented by a line connecting dots with solid lines for a description.

The display luminance of the pixel is proportional to a time corresponding to the pulse width of a modulation signal to be applied to the pixel because the pulse width modulation is carried out based on a kind of modulation reference potential according to the first embodiment. That is, the luminance data is proportional to the luminance.

There are 525 horizontal periods in a frame time. Respective row wirings are selected successively in this time. A frame scanning is carried out so as to have a vertical blanking period for 45 lines because the display panel has 480 rows, so that frequency matching with an inputted TV signal is secured. If a time necessary for changing over the row wiring is determined to be 10% the horizontal time, the maximum time of the modulation signal is 90% the horizontal period. Then, for example to acquire 256 grades of the modulation signals with 8-bit width data, that is, 256-gradation data as the luminance data, the frequency (fPCLK) of an actual modulation clock (PCLK) is expressed as followed:

$$fPCLK=60\times525\times256/0.9\approx9\text{ MHz} \qquad \text{Expression (1).}$$

Figure 4:
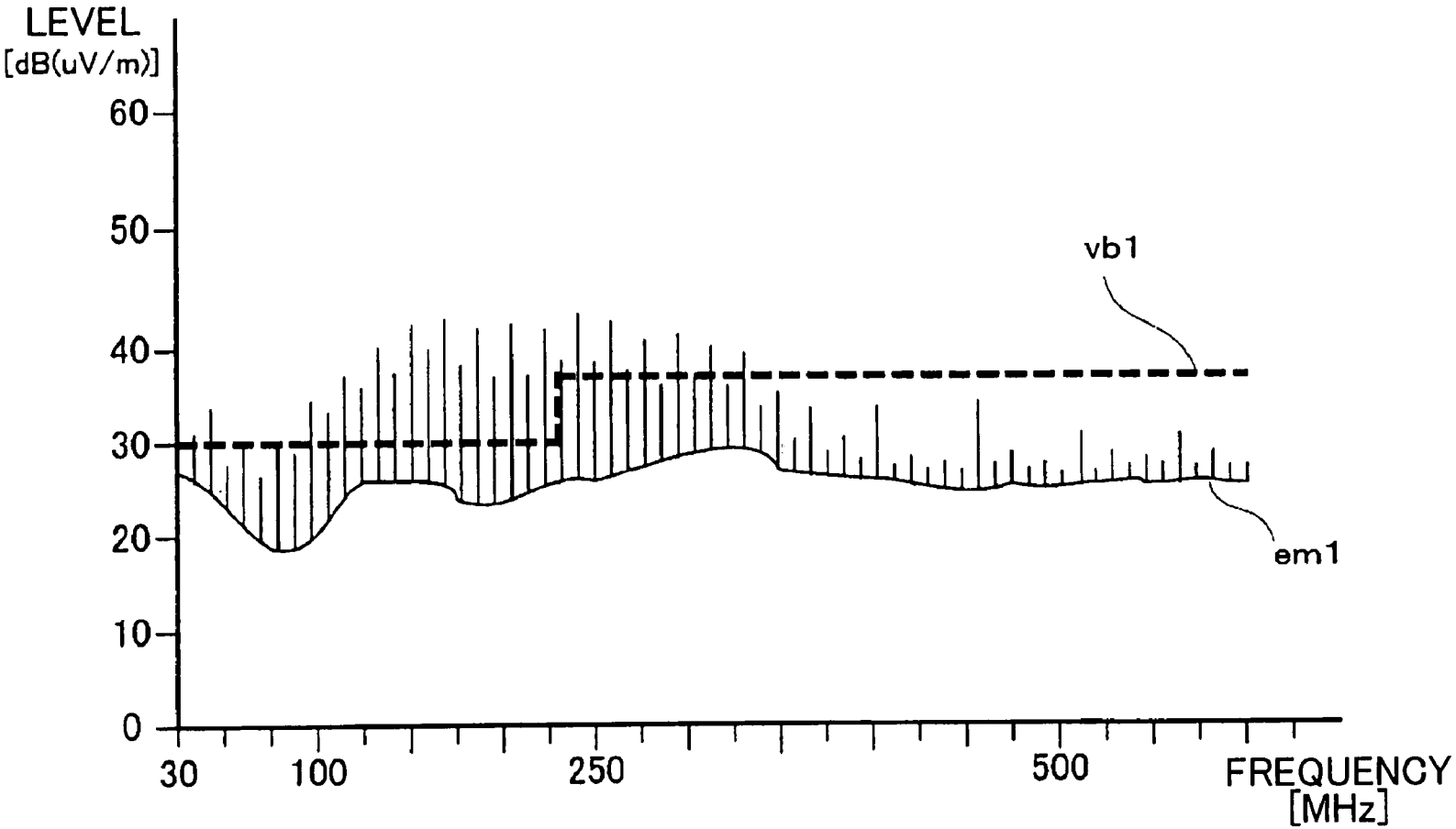
FIG. 4 is a diagram showing schematically a result of measurement of EMI upon driving based a conventional driving method.

FIG. 4 shows schematically a result of measurement of the EMI when the matrix panel 1 is driven. In FIG. 4, its abscissa axis indicates the frequency while its ordinate axis indicates electric field intensity. Here, em1 indicates a detected unnecessary radiation and vb1 indicates the reference level of class B of VCCI.

It has been found that as shown in FIG. 4, PCLK harmonics of a level exceeding VCCI class B is radiated from the matrix panel in a frequency band of 100 MHz–400 MHz and detected.

Hereinafter, a method for suppressing the harmonics of the modulation clock (PCLK) below a predetermined EMI level, for example, a level indicated by vb1 without affecting a displayed image will be described.

(Reduction of Unnecessary Radiation)

Figure 5:
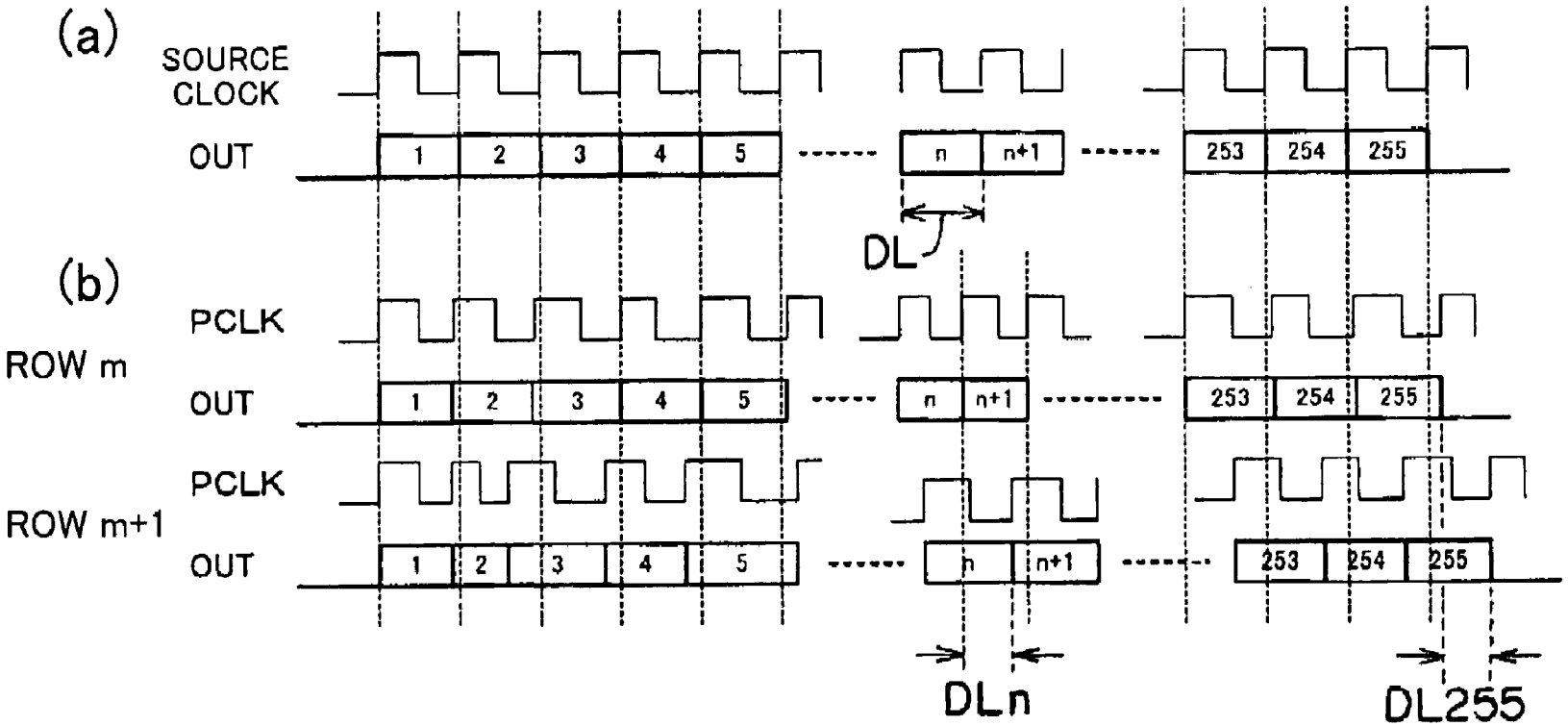
FIG. 5*a* is a diagram showing a source clock and a modulation signal waveform when the pulse width modulation is carried out with the source clock and FIG. 5*b* is a diagram showing a modulation clock (PCLK) frequency-modulated and a modulation signal waveform for rows m, m+1 subjected to the pulse width modulation with PCLK.

The PCLK generating portion 40 shown in FIG. 1 frequency-modulates 9 MHz source clock into a modulation clock (PCLK) with changes in frequency of ±1% in order to reduce the unnecessary radiation. FIG. 5*a* shows a source clock of a specified frequency and a modulation signal waveform which is pulse-width-modulated synchronously with the source clock. FIG. 5*b* shows a modulation clock (PCLK) gained as a result of frequency modulation and a modulation signal waveform which is pulse-width-modulated synchronously with the PCLK about rows m, m+1 on the matrix panel 1. In addition to the method of frequency modulating the generated source clock into the modulation clock, the modulation clock (PCLK) can be generated directly by using a voltage control oscillator as described later. The latter method has the same meaning of frequency-modulating an assumed source clock (virtual source clock) of a constant frequency.

The rise startup time of the modulation signal waveform on rows m, m+1 shown in FIG. 5*b* is expressed at the same position as the rise startup time of the modulation signal waveform of a source clock shown in FIG. 5*a* to facilitate comparison of the pulse widths of the modulation signals of both. The phases in a horizontal scanning period are different between the rows m and m+1, so that the frequency in a horizontal scanning period is deviated, in other words, deflected by a unit cycle. More specifically, a difference between a pulse width corresponding to luminance data n supplied to a pixel on the row m and a pulse width corresponding to luminance data n supplied to the row m+1 is DLn and a difference between a pulse width corresponding to luminance data 255 supplied to a pixel on the row m and a pulse width of luminance data 255 supplied to a pixel on the row m+1 is DL255. Then, as described later, the difference in the display luminance of the pixel depending on these differences is preferred to not exceed, for example, DL corresponding to an luminance data based on the source clock. The aforementioned difference in the display luminance is preferred to be below the common tolerance on all gradation levels such as n=1, 2, 3, . . . 255 except 0 or major gradation levels such as n=1, 2, 3, . . . 200.

The modulation clock (PCLK) is frequency-modulated, so that frequency deviation to 9 MHz is ±90 kHz. For example, on the $11^{th}$ harmonics component of the modulation clock (PCLK), its frequency deviation is expanded, so that it is diffused (spread) over 1.98 MHz bandwidth, which is ±1% with respect to the central frequency of 99 MHz. Because the unnecessary radiation which is the $11^{th}$ harmonics component is diffused (spread) over 1.98 MHz bandwidth in a measuring band of 120 kHz for measuring the EMI, energy is multiplied by 120 kHz/1.98 MHz and measured. That is, it is multiplied by $1/16.5$ times. This corresponds to that the EMI radiation is reduced by about 12 dB. Likewise, because energy is multiplied by 120 kHz/3.78 MHz at 198 MHz which is the $22^{nd}$ harmonics, the EMI radiation is reduced by about 15 dB.

Therefore, the unnecessary radiation in a band of 120 kHz for measuring the EMI is reduced largely, the high order harmonics of the modulation clock (PCLK) in FIG. 4 is reduced by 12 dB or more in a band of more than 100 MHz. Then, this can be suppressed to an unnecessary ration below the standard of VCCI or the like.

To acquire a modulation clock (PCLK) by frequency-modulating an actually existing source clock, energy of the modulated clock (PCLK) which is obtained by frequency modulation needs to be dispersed equally over ±1% in frequency. For example, the cycle of the PCLK may be changed so that about the PCLK is deflected by ±1% at random. The frequency (cycle) of the PCLK may be swept linearly or curvedly.

(Tolerable Condition of Image Quality)

According to the first embodiment of the present invention, the source clock is frequency-modulated at random so as to acquire the modulation clock (PCLK). That is, according to this example, the cycle of the PCLK is selected at random to reduce the level of harmonics of the modulation clock (PCLK) and its frequency is changed.

If the frequency of the modulation clock is not changed depending on the display position or luminance data in order to change the modulation clock (PCLK) directly related to the luminance, the luminance is changed if a clock having a constant frequency is used as shown in FIG. 5*a*. It is estimated that the change in luminance due to the display position or luminanced at a worsens the image quality. Thus, the inventor of the present invention considered a method which blocks the image quality from being deteriorated by reducing the harmonics.

As a result of estimation on the quality of an image displayed on the matrix panel using the modulation clock frequency-modulated, it has been found that a difference in display luminance can be accommodated within a range which does not deteriorate the image quality if a display is carried out on pixels corresponding to two adjacent scanning lines based on arbitrary same luminance data by restricting the frequency deviation. The difference in the display luminance can be quantified, for example, as a difference in luminance in a single frame period or a difference in average luminance within a period of two or more frames. The range which causes no deterioration in image quality, namely, the tolerable value does not need to be a constant value to all luminance levels but maybe determined depending on luminance data. Here, the modulation clock is frequency-modulated for the difference in display luminance displayed on pixels on adjacent rows not to exceed a difference in display luminance obtained by adjacent luminance data on the luminance level gained by any luminance data, that is, a difference in luminance equal to a single gradation. Consequently, the change in image quality becomes out of consideration. That is, if it is assumed that the luminance data normalized by 256 of a pixel on the row m which is an arbitrary row is n while normalization luminance normalized by the same 256 is L (m, n), if an expression (2):

$$L(m+1, n-1)<L(m, n)<L(m+1, n+1)$$

is established, the deterioration in image quality is hardly recognized.

As described above, the pulse width of the modulation signal is proportional to the luminance because pulse width modulation is executed according to the first embodiment. Thus, in the condition (2), the luminance may be replaced with jitter amount of pulse width. If it is assumed that the luminance data of the row m which is an arbitrary row is n while the normalization pulse width of normalized modulation signal waveform so that the pulse width obtained by PCLK when no frequency modulation is carried out is equal to the luminance data is T(m, n), if an expression (3):

$$T(m+1, n-1)<T(m, n)<T(m+1, n+1)$$

is established, the deterioration in the image quality is hardly recognized.

Further, it has been found that if such a PCLK that does not exceed ½ the difference in luminance (difference in luminance equal to a single gradation) of the display luminance displayed based on the luminance data of adjacent two levels is used in order to reduce the deterioration in image quality, there is little deterioration in image quality. According to the condition of this case, it can be considered that the luminance is replaced with the jitter amount of the pulse width. At this time, the conditions of the above-described expressions (2), (3) turn to the conditions of expressions (2'), (3')

$$(L(m+1, n-1)+L(m+1, n))/2<L(m, n)<((L(m+1, n)+L(m+1, n+1))/2 \quad \text{Expression (2')}$$

$$(T(m+1, n-1)+T(m+1, n))/2<T(m, n)<((T(m+1, n)+T(m+1, n+1))/2 \quad \text{Expression (3')}$$

A following description is made under the conditions (2), (3).

Figure 6:
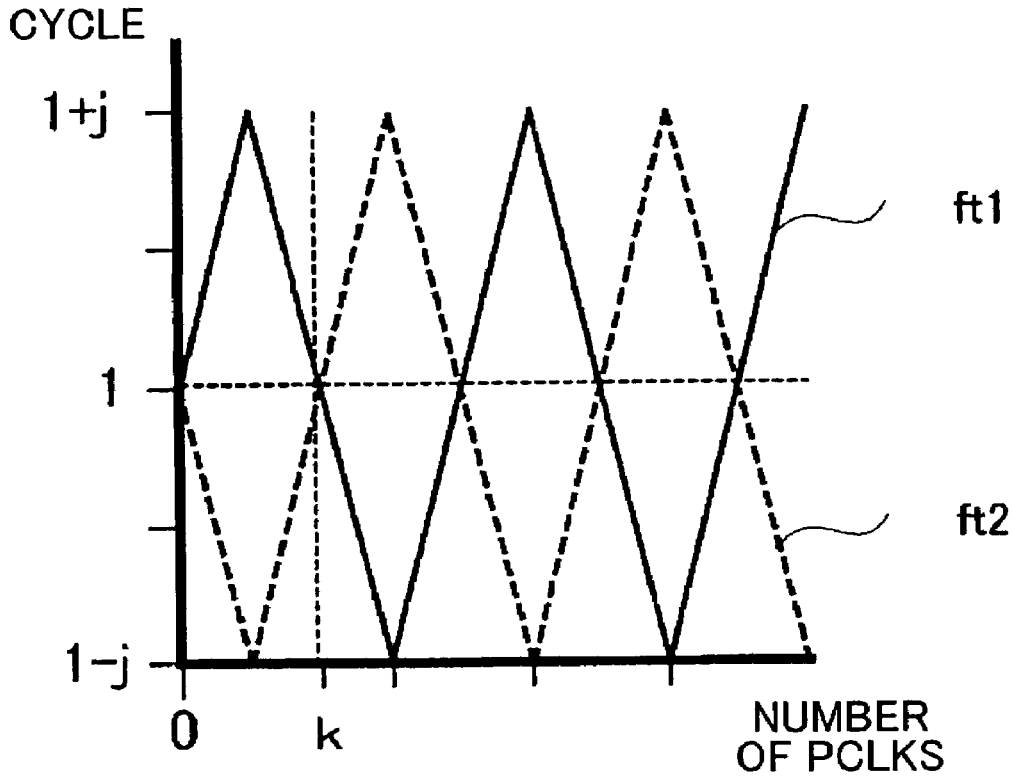
FIG. 6 is a diagram showing the cycle of PCLK when the cycle of the PCLK is swept linearly.

In FIG. 6, ft1 indicates changes in frequency of the PCLK. In FIG. 6, its ordinate axis indicates the cycle of PCLK and its abscissa axis indicates the quantity of PCLKs (corresponding to luminance data). FIG. 6 indicates a case where the cycle of the PCLK is swept linearly. When the frequency deviation is small, if the frequency of the PCLK is changed linearly, it can be regarded that the cycle of the PCLX is a linear change.

If the cycle of the PCLK is swept linearly as shown in FIG. 6, a difference in luminance occurs between any rows. Thus, if the frequency modulation is carried out under the conditions (2), (3) in the same way as when the PCLK cycle is changed at random as described above, there is little deterioration in image quality.

If speaking more in detail, preferably, the cycle for sweeping the cycle of the PCLK linearly as shown in FIG. 6 is shorter than the maximum time of the modulation signal from the condition (3).

It is assumed that ft1 is the characteristic of PCLK on the row m and ft2 is the characteristic of PCLK on the row m+1. In FIG. 6, ft1, ft2 indicate the relation of the modulation clock (PCLK) in which the difference in luminance between adjacent row wiring is maximized. When ft2 turns into opposite phase to ft1 as shown in FIG. 6, a maximum luminance difference is generated between adjacent rows.

If it is assumed that the deviation of the cycle of the PCLK when the pulse width modulation is started is 0, the PCLK number (luminance data) that the deviation of the cycle (ft1, ft2) of the PCLK turns to 0 again is k and the maximum deviation of the cycle is 1±j, the luminance (that is, length of the modulation signal) of the luminance of luminance data k−1 on the row m is larger than the luminance (that is, length of the modulation signal) of luminance data k−1 of the row m+1 because the cycle of the modulation clock (PCLK) is long at ft1 and short at ft2. If it is assumed that the luminance data of the row m which is an arbitrary row is n while the normalization pulse width of a corresponding modulation signal waveform is T(m, n), an expression (4):

$$T(m+1, k-1)<T(m, k-1)$$

is established.

Because the modulation signal increases monotonously to the luminance data, an expression (5):

$$T(m, k-1)<T(m, k)$$

is established.

It comes that the inequality on the left side about the condition for causing no deterioration in image quality of the expression (3) is always established from the expressions (4), (5). Therefore, the condition which causes no deterioration in image quality of the expression (3) can be expressed in an expression (6):

$$T(m, k)<T(m+1, k+1).$$

If the expression (6) is established, there is little deterioration in image quality.

If it is assumed that when pulse width modulation is carried out with the source clock, the pulse width corresponding to luminance data k of an arbitrary column is T(k) and a time difference of adjacent luminance data of an arbitrary column is ΔT (=1), where k>>1, an expression (7):

$$T(m, k)=T(k)\times(1+j/2)$$

and an expression (8):

$$T(m+1, k+1)\approx T(k)\times(1-j/2)+\Delta T$$

are established.

If the expressions (7), (8) are substituted into the expression (6), an expression $$T(k)\times(1+j/2)<T(k)\times(1-j/2)+\Delta T$$

is established.

If the condition in the expression (9) is arranged, an expression (10):

$$T(k)\times j<\Delta T$$

is established.

When the maximum deviation of the cycle is assumed to be ±1% (j=±0.01) k only needs to be equal to or less than 100 because T(k)=ΔT×k is established in the pulse width modulation with the source clock.

It has been found that if the above-described condition is established, there is recognized little deterioration in image quality and further, gradation characteristic can be reproduced faithfully.

According to this embodiment, the condition about the modulation clock (PCLK) is indicated by paying attention on the characteristic of human vision which is sensitive to the difference in luminance between adjacent lines. On the other hand, because the human vision is not so sensitive to the gradation characteristic, the condition about the PCLK from the gradation characteristic is neglected according to the first embodiment. However, if a modulation clock (PCLK) which deviates the gradation characteristic largely is adopted in the first embodiment, it is further preferable to convert the gradation according to a lookup table (not shown) so as to make the gradation characteristic meet the luminance data.

As described above, the unnecessary radiation from the display panel can be reduced by frequency-modulating the modulation clock (PCLK) for pulse width modulation while maintaining a high image quality in the first embodiment. Further, the deterioration in image quality can be suppressed by limiting the frequency deviation to equal to or less than the predetermined tolerable value as described above.

(Second Embodiment)

Next, the second embodiment will be described.

According to the first embodiment, the condition about the frequency modulation of the modulation clock (PCLK) is indicated about the difference in luminance between adjacent rows, which is a problem in subjective evaluation. An object of the second embodiment is to reproduce the luminance data and gradation characteristic of luminance faithfully. Because the structure of the image display unit and the operation of the unnecessary radiation of the second embodiment are equal to the first embodiment, a description thereof is omitted.

(Tolerable Condition of Image Quality)

According to the second embodiment of the present invention, the modulation clock (PCLK) is obtained by frequency-modulating the source clock at random like the first embodiment. That is, according to this example, the cycle of the PCLK is selected at random to reduce the level of its harmonics and its frequency is changed.

Figure 7:
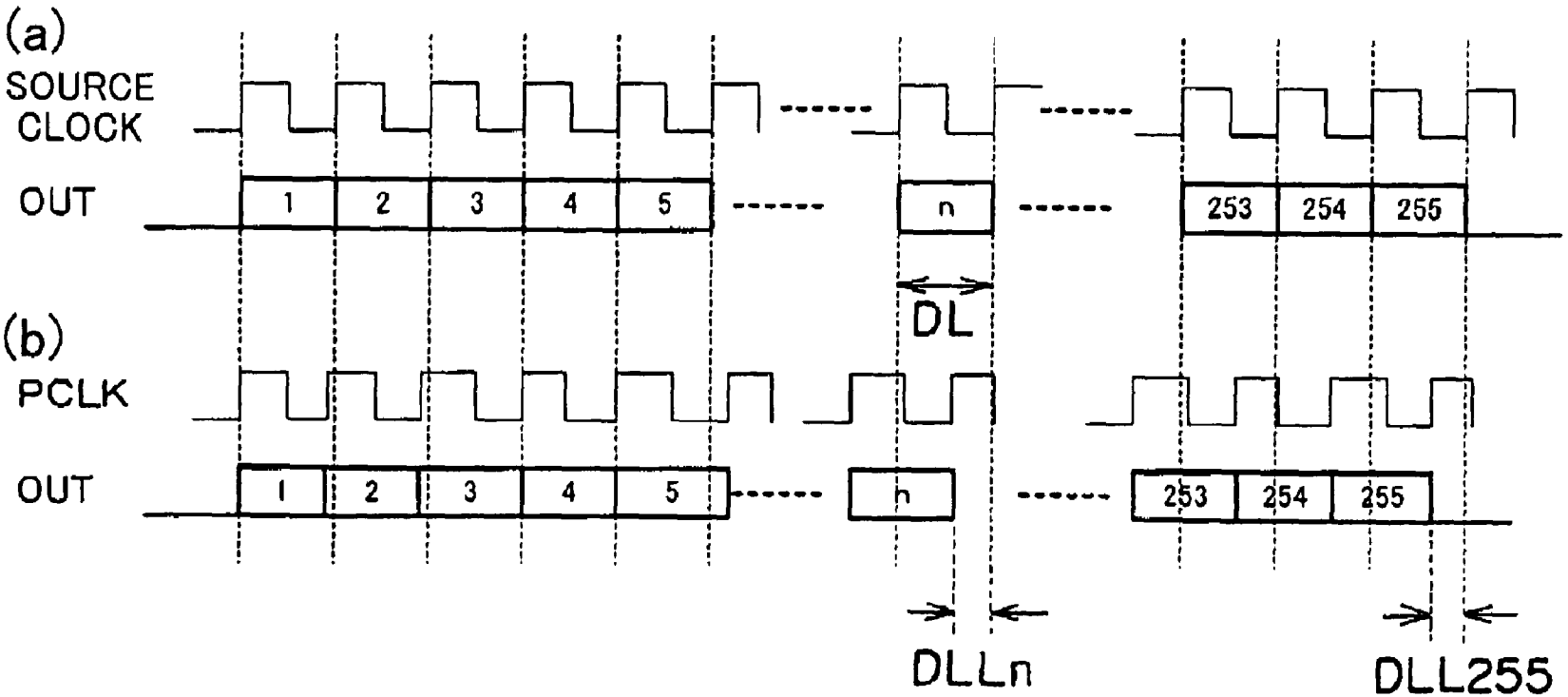
FIG. 7*a* is a diagram showing the modulation signal waveform when the pulse width modulation is executed with a source clock and FIG. 7*b* is a diagram showing the modulation signal waveform when the pulse width modulation is executed with a modulation clock (PCLK)

FIG. 7*a* shows a source clock and a modulation signal waveform in case where pulse width modulation is executed with this source clock. FIG. 7*b* shows the modulation clock (PCLK) of row wiring at an arbitrary row m and a modulation signal waveform when the pulse width modulation is executed with this modulation clock (PCLK).

Like the first embodiment, the luminance is changed depending on a display position and luminance data in order to change the modulation clock (PCLK) closed related to luminance. The change in luminance due to the display position or luminance data is likely to deteriorate the image quality. A method which refrains from deteriorating the image quality by reducing harmonics will be described below.

The second embodiment concerns a method for matching the luminance data with the characteristic of luminance in order to match the gradation characteristic at a further higher accuracy. If a difference between the luminance which may be obtained when pulse width modulation is executed with reference to the source clock and the luminance obtained when the pulse width modulation is carried out with reference to the modulation clock (PCLK) frequency-modulated is less than a differential in display luminance of a single gradation obtained when the pulse width modulation is carried out with the-source clock, the gradation characteristic can be displayed faithfully. More specifically, it comes that a difference between the pulse width of a modulation signal subjected to the pulse width modulation according to the source clock of a constant frequency (cycle) and luminance data n and the pulse width of a modulation signal subjected to pulse width modulation according to the modulation clock frequency-modulated and luminance data n is DLLn and a difference between the pulse width of a modulation signal subjected to pulse width modulation according to the source clock of a constant frequency (cycle) and luminance data 255 and a pulse width of a modulation signal subjected to the pulse width modulation according to the modulation clock frequency-modulated and luminance data 255 is DLL255. As described later, the difference in display luminance of the pixel based on these differences is preferred to not exceed the DL equal to a single luminance data based on the source clock. Further, it is preferable that the aforementioned difference in display luminance is below the tolerable value on all gradation levels such as n=1, 2, 3, . . . 255 except 0 or major gradation levels such as n=1, 2, 3, . . . 200.

If it is assumed that the normalization luminance corresponding to luminance data n of an arbitrary row when the pulse width modulation is carried out with the source clock is L(n) and the luminance data at the row m which is an arbitrary row when the pulse width modulation is carried out with the modulation clock (PCLK) frequency-modulated is n and a corresponding normalization luminance is L(m, n), if an expression (11):

$$L(n-1<L(m,\ n)<L(n+1)$$

is established, deterioration in image quality is hardly recognized and the gradation characteristic can be displayed faithfully.

According to the second embodiment, the pulse width of the modulation signal is proportional to luminance because the pulse width modulation is carried out like the first embodiment. Thus, in the condition of the expression (11), the luminance may be replaced with the jitter amount of the pulse width. That is, when it is assumed that the luminance data on the row m which is an arbitrary row is n and the normalization pulse width of a corresponding modulation signal waveform is T(m, n), if the luminance data at an arbitrary row is n and a corresponding normalization pulse width is T(n) when the pulse width modulation is carried out with the source clock and the luminance data on the row m which is an arbitrary row is n and the normalization pulse width is T (m, n) when the pulse width modulation is carried out with the modulation clock (PCLK) frequency-modulated, if an expression (12):

$$T(n-1)<T(m,\ n)<T(n+1),$$

deterioration in image quality is hardly recognized and further, the gradation characteristic can be reproduced faithfully.

Further, it has been found that if a difference in display luminance between the luminance which may be obtained when the pulse width modulation is carried out with the source clock and the luminance obtained when the pulse width modulation is carried out with the modulation clock (PCLK) frequency-modulated is less than ½ the luminance obtained when the pulse width modulation is carried out with the source clock, the gradation characteristic can be displayed further faithfully. In the condition of this case, the luminance may be replaced with the jitter amount of the pulse width. The conditions of the aforementioned expressions (11), (12) can be expressed as the conditions of expressions (11'), (12').

$$(L(n-1)+L(n))/2<L(m,\ n)<(L(n)+L(n+1))/2 \qquad \text{Expression (11')}$$

$$(T(n-1)+T(n))/2<T(m,\ n)<(T(n)+T(n+1))/2 \qquad \text{Expression (12')}$$

A following description is made under the conditions of the expressions (11), (12).

Figure 8:
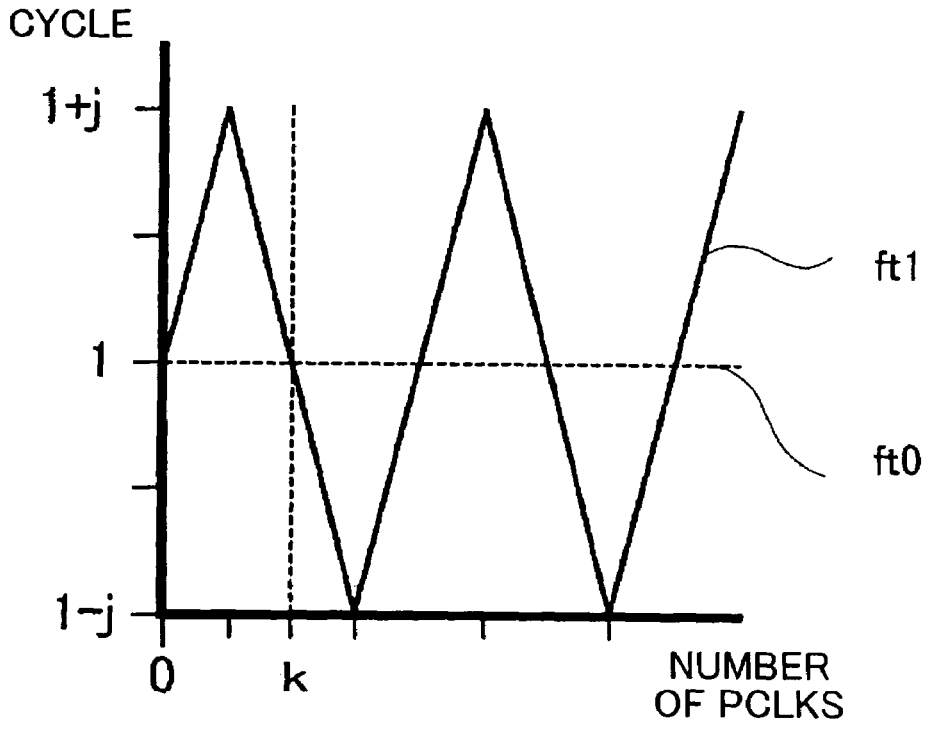
FIG. 8 is a diagram showing the cycle of PCLK and the cycle of the source clock when the cycle of the PCLK is swept linearly.

Next, FIG. 8 shows an example in which the frequency is changed. In FIG. 8, its ordinate axis indicates the cycle of PCLK and its abscissa axis indicates the number of PCLKs (luminance data). FIG. 8 indicates a case where the cycle of PCLK is swept linearly. If the frequency deviation is small, it can be regarded that a change in the cycle of the PCLK is a linear change by changing the frequency of the PCLK linearly.

If the cycle for sweeping the cycle of the PCLK linearly is shorter than the maximum time of the modulation time in FIG. 8, it is preferable from the condition of the expression (12).

In FIG. 8, ft1 indicates a change in the cycle of the PCLK on the row m while ft0 indicates the cycle of the source clock.

If it is assumed that the deviation of the cycle of the PCLK when pulse width modulation is started is 0, the number of the PCLKs (luminance data) in which the deviation of the cycle of the PCLK returns to 0 is k, and the maximum deviation of the cycle is 1±j, the pulse width corresponding to luminance data k on an arbitrary row when the pulse width modulation is carried out with the source clock is T(k). Thus, an expression (13):

$$T(m,\ k)-T(k)\times(1+j/2)$$

is established.

Further, because an expression (14):

$$T(k)=\Delta T\times k$$

is established when the pulse width modulation is carried out with the source clock, an expression (15):

$$-\Delta T<\Delta T\times k\times(j/2)<+\Delta T$$

is established from the condition of the expression (12) and the expressions (13), (14).

For example, if it is assumed that the maximum deviation of the cycle is ±1% (j=±0.01), k only needs to be equal to or less than 200.

If the above-described condition is established, deterioration in image quality is hardly recognized and further, the gradation characteristic can be reproduced faithfully.

By frequency-modulating the modulation clock (PCLK) for executing the pulse width modulation while maintaining high gradation characteristic with a high quality image in the second embodiment as described above, the unnecessary radiation can be reduced (Third Embodiment)

Next, the third embodiment of the present invention will be described.

In the first embodiment and second embodiment, the condition for the frequency modulation of the modulation clock (PCLK) about a difference in luminance between adjacent rows or relative to the luminance of the source clock, which is a problem in subjective evaluation, is indicated. According to the third embodiment, the aforementioned difference in display luminance is not set below a common tolerable value but below a tolerable value which is different depending on each gradation level on all gradation levels such as n=1, 2, 3, . . . 255 except 0 in order to obtain a further excellent image quality. Because the structure of the image display unit and the unnecessary radiation reduction method are the same as the first embodiment, description thereof is omitted.

(Tolerable Condition of Image Quality)

A case where a gamma compensated image signal (a signal raised to the 0.45 power preliminarily) is quantized by 8 bits to eliminate gamma characteristic of a CRT such TV of an inputted image signal will be considered.

Although not shown, a gamma compensated image signal inputted to the image display unit is converted to luminance data having a linear characteristic proportional to luminance by an inverse γ converter (a look-up table having a characteristic of, for example, 2.2 power constituted of a ROM). As indicated in the first embodiment, the matrix panel is driven corresponding to luminance data.

The gamma compensated image signal has a gradation characteristic equivalent to 7 bits on high luminance side in which the luminance is linear. Thus, on the high luminance side, a difference in luminance between adjacent rows equivalent to 7 bits can be allowed. Further on a low luminance side, more gradations than 8 bits are required in its linear characteristic.

As a result of consideration by the inventor and other people, it has been found that a PCLK having a lower difference in luminance than adjacent data of gamma compensated image signal which is an input signal enables a better image quality to be obtained in the first embodiment and second embodiment (below a difference in luminance of a single gradation of the source clock or PCLK). This condition is strict on the low luminance side and loose on the high luminance side. In other words, the tolerable luminance data is small when the luminance data is small and when the luminance data is large, is increased.

Figure 9:
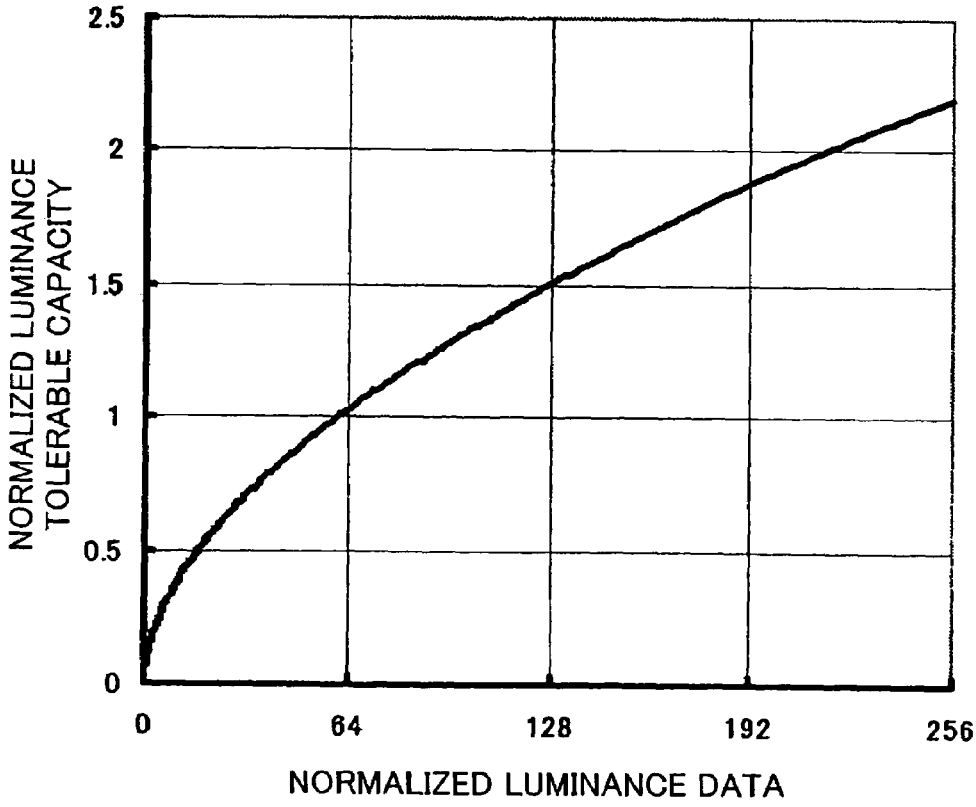
FIG. 9 is a diagram showing a difference in luminance between adjacent data of gamma compensated image signal.

More specifically, FIG. 9 shows a difference in luminance of adjacent data of the gamma compensated image signal. In FIG. 9, its ordinate axis indicates normalization luminance tolerable amount of adjacent image data and its abscissa axis indicates normalization luminance data. The data shown in FIG. 9 can be said to be tolerable value specified for each luminance data (that is, number of PCLKs).

More specifically, if the curve of the tolerable value in FIG. 9 is assumed to be f(n), the f(n) can be calculated as follows.

Assume that a gamma compensated image signal normalized by 256 like the luminance data is N.

The relation between the luminance data and gamma compensated image signal N is as follows.

$$(N/256)\hat{}\gamma=n/256 \qquad \text{Expression (16)}$$

^ means power and γ is 1.8 to 2.8 from the characteristic of the inverse γ converter, 2.2 as its standard. From the expression (16), an expression (17):

$$(n/256)\hat{}(1/\gamma)=N/256$$

is established.

Because the luminance data corresponding to a single gradation portion of the gamma compensated image signal is considered to be a tolerable value, if the tolerable value on the luminance data is assumed to be Δn, an expression (18):

$$((n+\mathbf{66}\ n)/256)\hat{}(1/\gamma)-(n/256)\hat{}(1/\gamma)=((N+1)/256)-(N/256)$$

is established.

If the expression (18) is Taylor-expanded and approximated, an expression (19):

$$(1/\gamma)\times(n/256)\hat{}((1/\gamma)-1)\times\Delta n=1$$

is established.

The tolerable value Δn on the luminance data is expressed in expression (20):

$$\Delta n=\gamma\times(n/256)\hat{}(1-(1/\gamma))$$

from the expression (19).

Because a curve (function) to n of the tolerable value Δn on the luminance data is assumed to be f (n), an expression (21):

$$f(n)=\gamma x(n/256)\hat{}(1-(1/\gamma))$$

is established because the An of the expression (20) is just f(n).

Because $$L(m+1,\ n-1)=L(m+1,\ n)-f(n) \text{ and}$$

$$L(m+1,\ n+1)=L(m+1,\ n)+f(n)$$

are established if the frequency deviation is limited using an introduced tolerable value f(n) like the first embodiment, the condition (expression 2) indicated by the first embodiment is as follows.

That is, if the luminance data on the row m which is an arbitrary row is n and a corresponding normalized luminance is L(m, N), an expression (22):

$$|L(m,\ n)-L(m+1,\ n)|<f(n)$$

is established.

where | | means an absolute value.

In pulse width modulation, the pulse width and luminance of the modulation signal are proportional to each other as described above. Thus, in the condition of the expression (22), the luminance may be replaced with the jitter amount of the pulse width. That is, if the luminance data on the row m which is an arbitrary row is n and the normalization pulse width of a corresponding modulation signal waveform is T(m, n), an expression (23):

$$|T(m,\ n)-T(m+1,\ n)|<f(n),$$

where | | means an absolute value, is established because both the luminance and pulse width are normalized by 256.

Next, a condition for limiting the frequency deviation like the second embodiment will be described.

Because the normalization luminance L(n) corresponding to the luminance data n of an arbitrary row when the pulse width modulation is carried out with the source clock can be set to $$L(n-1)=L(n)-f(n),$$

$$L(n+1)=L(n)+f(n),$$

the condition indicated in the second embodiment (expression 11) is as follows.

That is, if the luminance data of the row m which is an arbitrary row is n and a corresponding normalization luminance is L(m, n) when the pulse width modulation is carried out with the modulation clock (FCLK) frequency-modulated, an expression (24):

$$|L(n)-L(m, n)|<f(n),$$

where | | means an absolute value, is established. Under the conditions of the expressions (22), (23), deterioration in image quality is hardly recognized.

In the pulse width modulation, the pulse width of the modulation signal is proportional to luminance as described previously. Thus, regarding the condition of the expression (24), the luminance may be replaced with the jitter amount of the pulse width. That is, if it is assumed that the normalization pulse width corresponding to luminance data n of an arbitrary row when the pulse width modulation is carried out with the source clock is T(n), the luminance data of the row m which is an arbitrary row when the pulse width modulation is carried out with the modulation clock (PCLK) frequency-modulated and a corresponding normalization pulse width is T (m, n), an expression (25)

$$|T(n)-T(m, n)|<f(n),$$

where | | means an absolute value, is established because the luminance and pulse width are normalized by 256. Under the conditions of the expressions (24), (25), deterioration in the image quality is hardly recognized.

Although according to the third embodiment, the inputted image signal is a gamma compensated signal, the tolerable value indicated in the first and second embodiments corresponds to a case where the aforementioned γ is 1 because the first and second embodiments indicates a case where the luminance data and luminance are proportional to each other.

Further, if the tolerable value f (n) is set to a value which does not exceed ½ the luminance (luminance equal to a single gradation) of adjacent luminance data as shown in the first and second embodiments, the deterioration in image quality can be reduced further. In this case, it is preferable if the tolerable value f(n) is replaced with f(n)/2.

The third embodiment has been described under the condition that the inputted image signal is a gamma compensated signal like TV signal.

Because the human sensitivity to brightness is expressed in logarithmic characteristic, a more excellent image can be obtained than the first and second embodiments regardless of inputted signal if a difference in luminance which is an equivalent stimulus value is assumed to be g (n) and g(n) is adopted instead of f(n) in the expressions (22)–(25). Because the g(n) is in the same tendency as the f (n) (when the luminance data is small, a tolerable difference in luminance is small and when the luminance data is large, the tolerable difference in luminance is large), a more excellent image than the first, second embodiments can be obtained even if a signal not gamma-compensated is displayed with the g(n) as the condition instead of the f(n).

If the number of gradations capable of being modulated is 8 bit or 256 gradations as exemplified, the conditions indicated in the first and second embodiments is a proper condition from the viewpoints of displaying an output of the modulator faithfully. However, if the number of gradations capable of being modulated is large like 12 bits, the condition indicated in the first and second embodiments is severe, so that sometimes deterioration in image quality cannot be seen even if the frequency modulation exceeding the condition is executed on the PCLK. Further, if the number of gradations capable of being modulated is small like 4 bits, the condition indicated in the first and second embodiments turns loose, so that an annoyance may occur even if the condition is satisfied. Thus, the condition indicated by the third embodiment is further preferable because this condition demands to display an inputted image signal faithfully and that there is no deterioration in image quality for human vision. Further, it is permissible to set up a different tolerable value for each gradation level group like tolerable value X1 when the gradation level (luminance data) n is 1–7, tolerable value X2≠X1 when the gradation level (luminance data) n is 8–15, tolerable value X3≠X1, X3≠X2 when the gradation level (luminance data) n is 16–31.

As described above, according to the third embodiment, the unnecessary radiation can be reduced and a higher quality image can be realized than the first and second embodiments.

(Fourth Embodiment)

Next, the fourth embodiment will be described. In the fourth embodiment, a method for realizing the condition of the PCLK indicated in the third embodiment simply will be shown.

Figure 10:
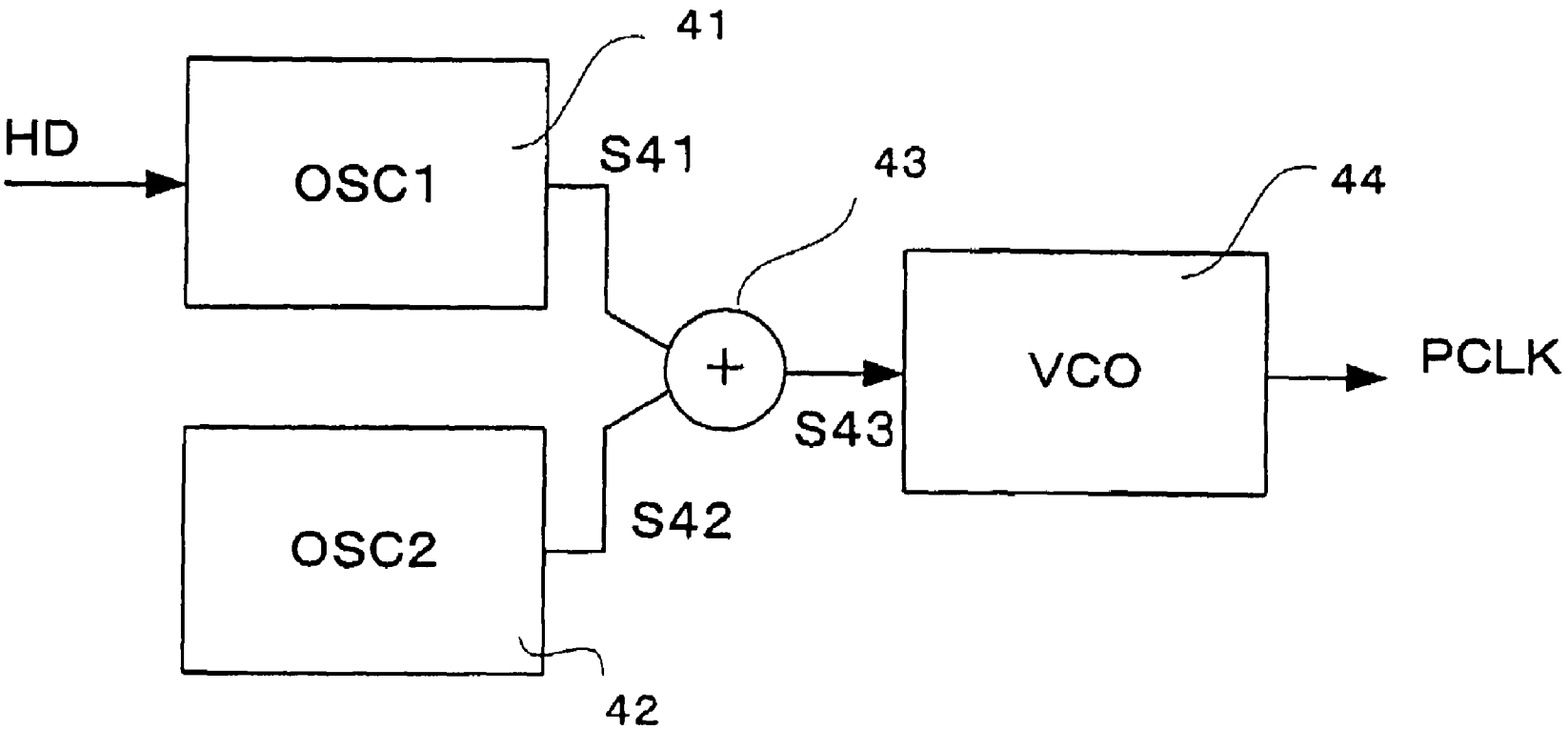
FIG. 10 is a diagram showing the structure of a PCLK generating portion.
Figure 11:
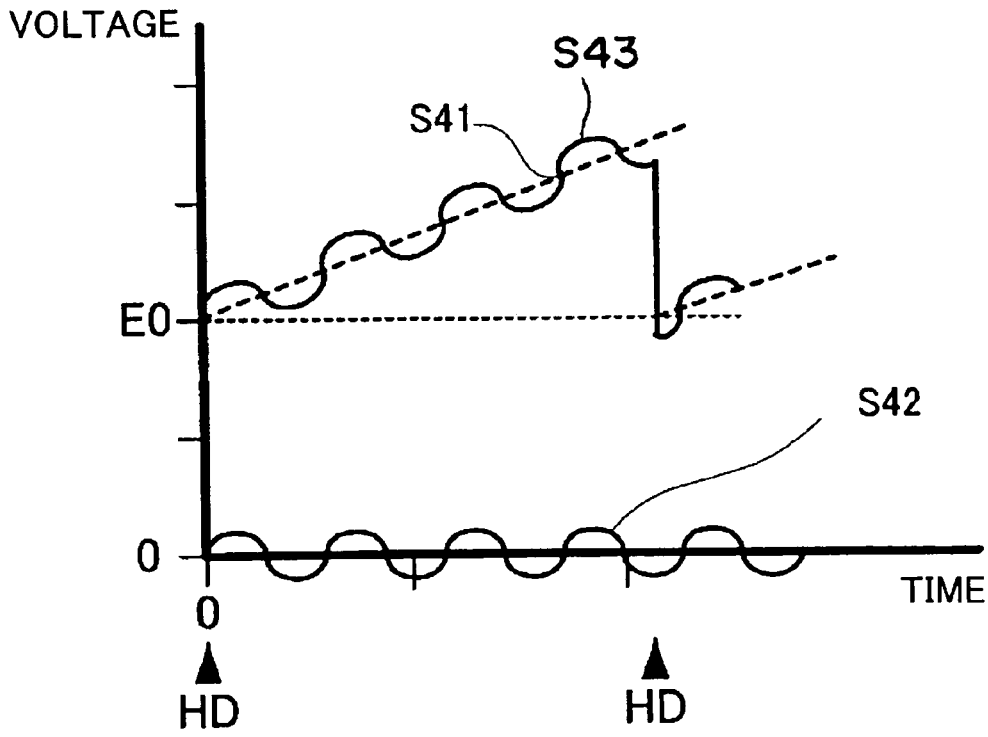
FIG. 11 is a graph showing the potential to be inputted to a voltage control oscillator.

FIG. 10 is a diagram showing the structure of the PCLK generating portion. Reference numeral 41 denotes an oscillator which is reset to a potential E0 by input of a signal (HD) synchronous with a selecting time of a row, more in detail, a rise-up timing of the modulation signal waveform, reference numeral 42 denotes an oscillator which oscillates at a minute voltage, reference numeral 43 denotes an adder, and reference numeral 44 denotes a voltage control oscillator which oscillates based on a frequency following an inputted voltage. In FIG. 10, the oscillator 41 is reset to the potential E0 at a timing of a HD signal and oscillates (S41) An output S42 of the oscillator 42 is added by an adder 43, which outputs an addition result S43 to a voltage control oscillator. In FIG. 11, its abscissa axis indicates a time while its ordinate axis indicates a voltage, indicating a potential from S41 to S43. The time indicated on the abscissa axis HD indicates a timing of the HD signal. As evident from FIG. 11, the oscillator 41 is reset by the rise-up timing (timing which outputs a HD signal) of the modulation signal waveform and outputs the same voltage E0 for any row. It is summed up with an output of the oscillator 42 by the adder 43 so as to output the S43. The S43 becomes substantially the same voltage at the rise-up timing of the modulation signal waveform and the voltage control oscillator 44 outputs a PCLK which is substantially the same frequency at the rise-up timing of the modulation signal waveform.

Figure 12:
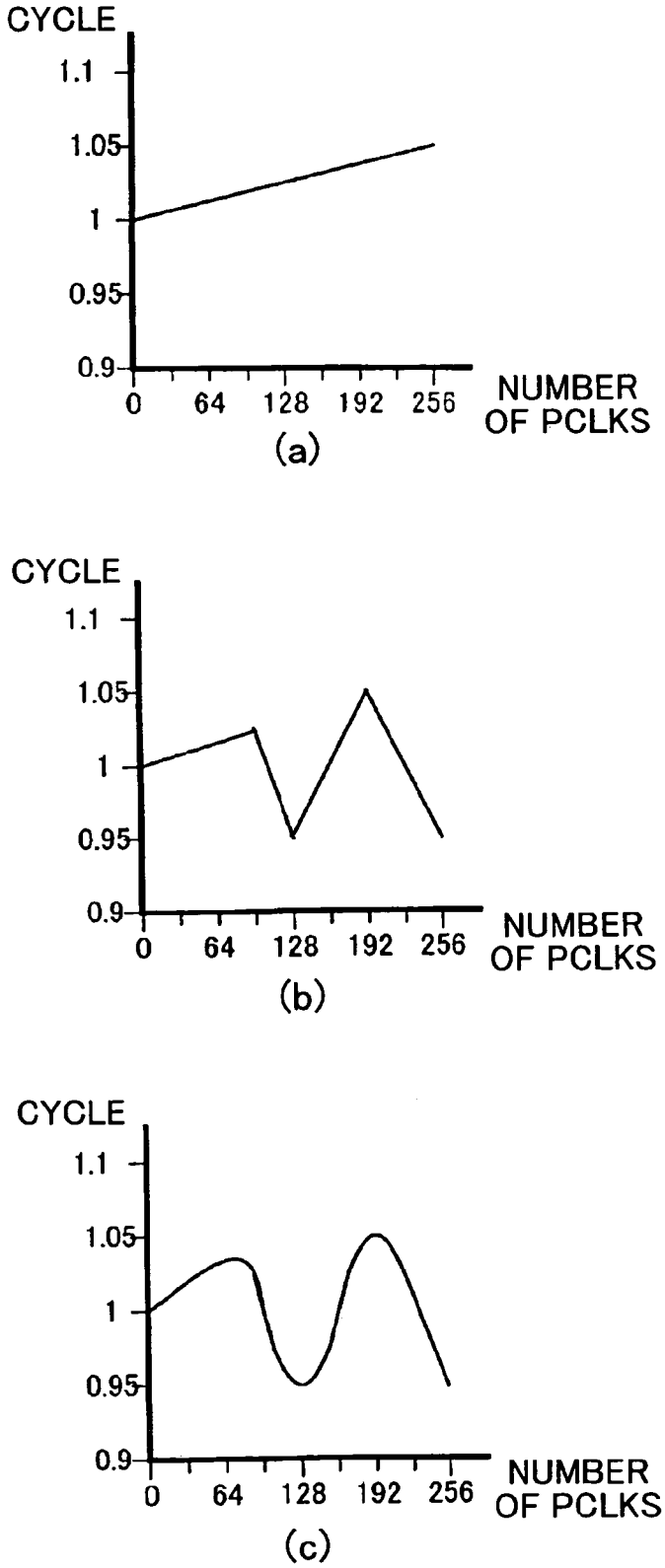
FIG. 12*a–c* are diagrams showing an example of the cycle of the PCLK frequency-modulated synchronously with the HD signal.

FIGS. 12*a*, 12*b*, 12*c* show an example of the cycle of the PCLK to the number of the PCLKs. The ordinate axis of each graph indicates the cycle of PCLK when the cycle of the source clock is normalized to 1 and its abscissa axis indicates the number of the PCLKs (that is, luminance data).

The cycle of a first PCLK is 1 and as the number of the PCLKs increases, the cycle is deviated largely. Although not shown, the cycle of the PCLK may be changed for each row. In that case, the cycle of the first PCLK is 1 and as the number of the PCLKs increases, the cycle is changed for each row. This embodiment is preferable as described in the third embodiment.

The characteristic indicated in FIG. 12*b* may cause a feeling of disharmony to the human being because there are some points of the PCLK number in which a differential value of the cycle is not continuous to the gradation characteristic. Thus, the characteristic that the differential values are continuous as indicated in FIGS. 12*a*, 12*c* is more excellent.

As described above, according to the fourth embodiment, the PCLK of the third embodiment can be generated easily. The unnecessary radiation is reduced and high-quality display can be realized.

(Fifth Embodiment)

Next, the fifth embodiment will be described. The fifth embodiment provides a method using the characteristic of human vision and the definition on the difference in luminance is different from the first, second and third embodiments. Because the structure of the image display unit and the unnecessary radiation reduction operation are the same as the first embodiment, description thereof is omitted.

(Tolerable Condition of Image Quality)

The human vision has a characteristic about an incidental image. As the fifth embodiment, a method for releasing the tolerable condition by using this incidental image will be described.

Figure 13:
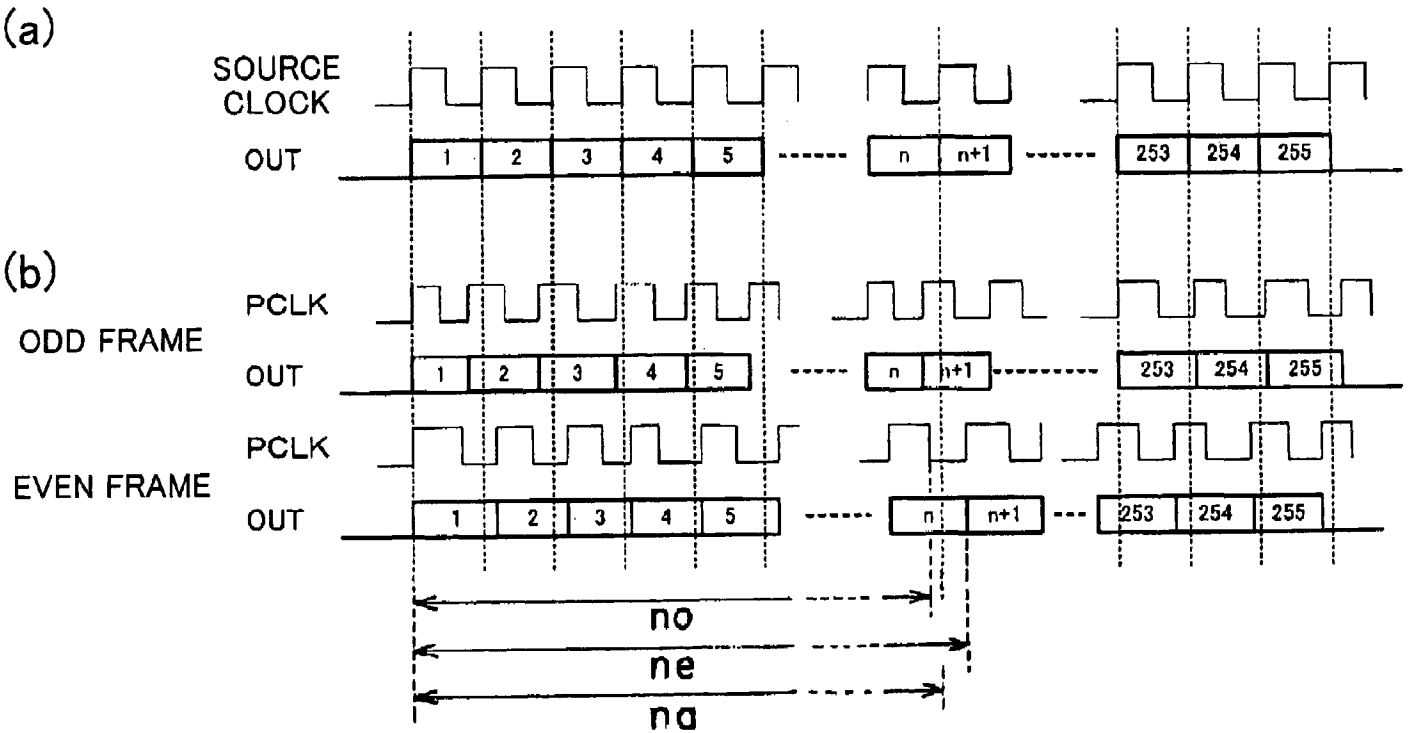
FIG. 13*a* is a diagram showing a source clock and a modulation signal subjected to the pulse width frequency with the source clock and FIG. 13*b* is a diagram showing a modulation signal waveform subjected to the pulse width modulation with the PCLK in an odd frame and an even frame.

FIG. 13*a* shows a source clock and a modulation signal waveform in case where the pulse width modulation is carried out with the source clock. FIG. 13*b* shows the modulation clock (PCLK) of a row wiring on the row m in odd/even frames and a modulation signal waveform in case where the pulse width modulation is carried out with this modulation clock (PCLK). A still image can be regarded as an average luminance of multiple frames because of the incidental image which is one of the human vision characteristic. If it is assumed that the pulse width of a modulation signal based on luminance data n in the odd frame, or light emission period (display luminance) of a pixel is no while the pulse width of a modulation signal based on the luminance data n in the even frame or the light emission period (display luminance) of a pixel is ne when it is intended to adjust the average luminance of two frames below a tolerable value, the average luminance na of the two frames is an average of the no and ne. Thus, the above-described first-fourth embodiments are established even if the display luminance is defined with this average.

A detailed description will be made below. If it is assumed that the luminance data on the row m which is an arbitrary row in the even frame is n, the normalization luminance normalized by 256 like the luminance data is Le (m, n), the luminance data on the row m which is an arbitrary row in the odd frame is n, the normalization luminance normalized by 256 like the luminance data is Lo (m, n) and the average normalization luminance of the even frame and odd frame is LL (m, n), an expression (26):

$$LL(m, n)=(1/2)\times(Le(m, n)+Lo(m, n))$$

is established.

As described above, the pulse width of the modulation signal and luminance are proportional to each other because the pulse width modulation is carried out in the fifth embodiment. Thus, under the condition of the expression (26), the luminance may be replaced with the jitter amount of the pulse width. At this time, if it is assumed that the luminance data on the row m which is an arbitrary row in the even frame is n, the normalization pulse width of the modulation signal waveform is Te (m, n), the luminance data on the row m which is an arbitrary row in the odd frame is n, the normalization pulse width of the modulation signal waveform is To (m, n), and the average normalization pulse width of the even frame and odd frame is TT (m, n), an expression (27):

$$TT(m, n)=(1/2)\times(Te(m, n)+To(m, n)$$

is established.

The fifth embodiment takes a condition that the average normalization luminance LL (m, n) and the average normalization pulse width TT (m, n) of the first embodiment are replaced with the normalization luminance L (m, n) and the normalization pulse width T (m, n) of the third embodiment. Although the condition is determined based on an average of the even frame and odd frame in the fifth embodiment, the condition may be determined based on an average of three or more frames and particularly, this is an effective method for driving of a high frame rate.

Because the average is determined based on the average of the even frame and odd frame in the fifth embodiment, it is capable of increasing the frequency deviation while maintaining an excellent image as compared to the first–third embodiments. The fifth embodiment is effective for a case where the harmonics of the modulation clock (PCLK) is large and a more effective countermeasure is needed.

As a special example of the fifth embodiment, it is preferable that the modulation clock (PCLK) is so generated that a sum of jitters in the even frame and odd frame to a source clock of the modulation clock (PCLK) for a row wiring of an arbitrary row m is of the same value on all rows.

It is further preferable that the modulation clock (.PCLK) is so set that the modulation clock (PCLK) for the row wiring of an arbitrary row m is a jitter amount of the same magnitude and in an opposite direction to the source clock.

As described above, according to the fifth embodiment, the frequency deviation of the PCLK of the first-third embodiment can be increased with little deterioration in image quality thereby reducing the unnecessary radiation further.

(Sixth Embodiment)

Next, the sixth embodiment will be described. According to the sixth embodiment, the harmonics of the modulation clock (PCLK) is large and the frequency deviation of the modulation clock (PCLK) needs to be increased further in order to reduce the harmonics. This embodiment is a countermeasure if the condition of the first–third embodiment cannot be realized.

Figure 14:
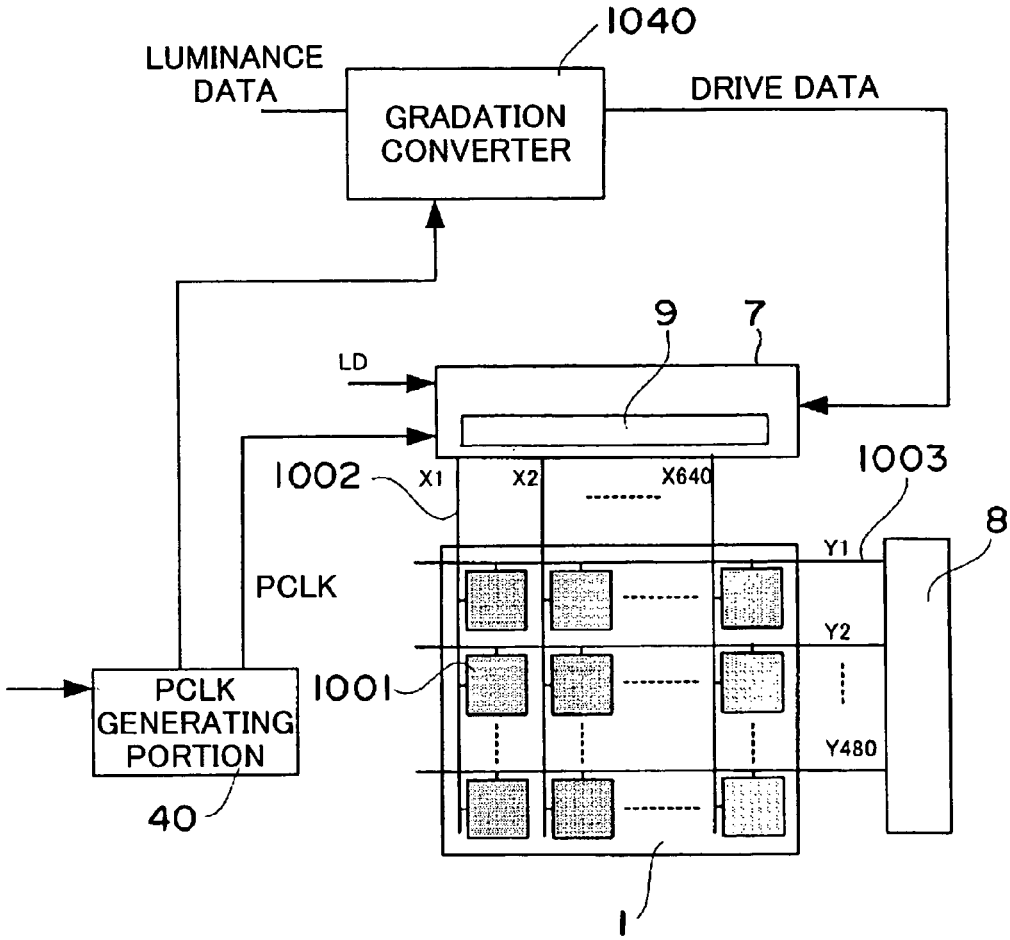
FIG. 14 is a structure diagram for explaining a driving unit for the matrix panel according to a sixth embodiment of the present invention.

FIG. 14 is a diagram showing the configuration of the sixth embodiment. Description of the same components as the first embodiment is omitted in FIG. 14.

In FIG. 14, reference numeral 1040 denotes a gradation converter. The gradation converter 1040 is comprised of a table for converting one or more gradations, switches for skipping the gradation conversion and the like. The gradation converter 1040 executes the gradation conversion to luminance data as described later and outputs drive data to a column driving circuit 7.

Figure 15:
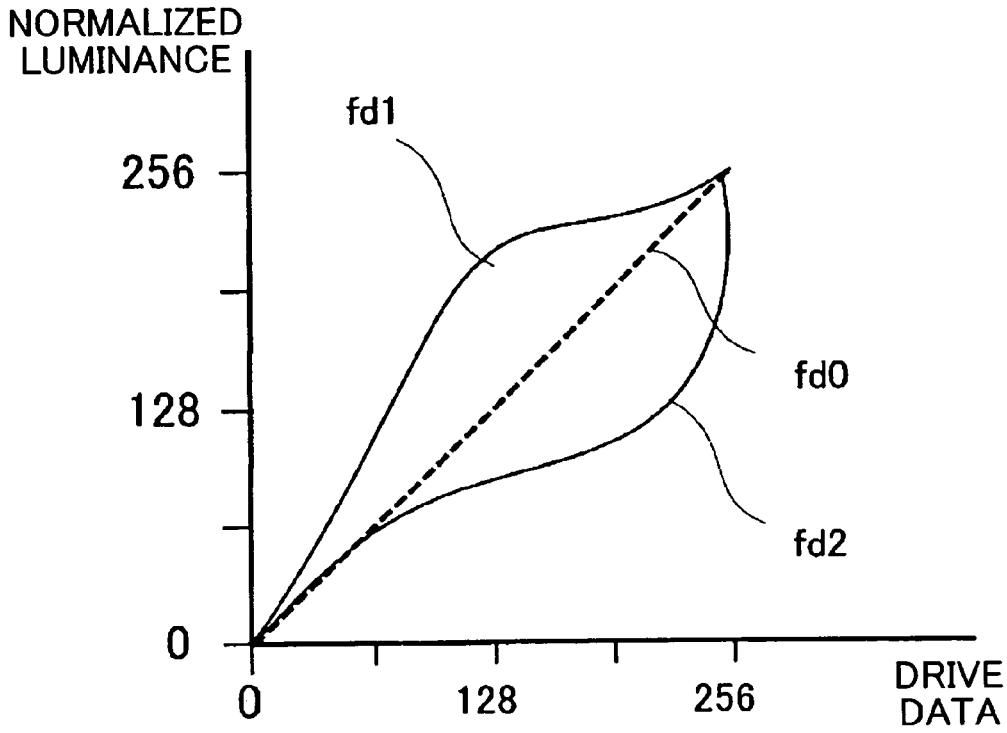
FIG. 15 is a diagram showing the characteristic of the PCLK according to the sixth embodiment.

The PCLK generating portion 40 executes frequency modulation so as to obtain the characteristic (fd1, fd2)

shown in FIG. 15 in order to reduce the harmonics of the modulation clock (PCLK). In FIG. 15, its ordinate axis indicates normalization luminance and its abscissa axis indicates normalization drive data. It is assumed that the characteristic of the PCLK on an arbitrary row m is fd1 and the characteristic of the PCLK on a row m+1 is fd2. The fd0 in FIG. 15 is the characteristic produced when the pulse width modulation is carried out with the source clock and this is indicated here for reference.

A difference in luminance between the characteristics fd1 and fd2 shown in FIG. 15 is so large a value that the tolerable value preferable for the first embodiment is not satisfied. That is, the difference of adjacent luminances is large. According to the sixth embodiment, the gradation converter 1040 converts this difference in luminance for each row. The gradation converter 1040 receives the frequency modulation condition (characteristic of the frequency of the PCLK) of the PCLK from the PCLK generating portion 40 so as to select a corresponding gradation conversion table. More specifically, plural gradation conversion tables (memory like ROM) are provided depending on the frequency modulation condition of the PCLK and by inputting the frequency modulation condition into upper address, the conversion table is changed over while by inputting luminance data into lower address, an output of data line is handled as drive data.

Figure 16:
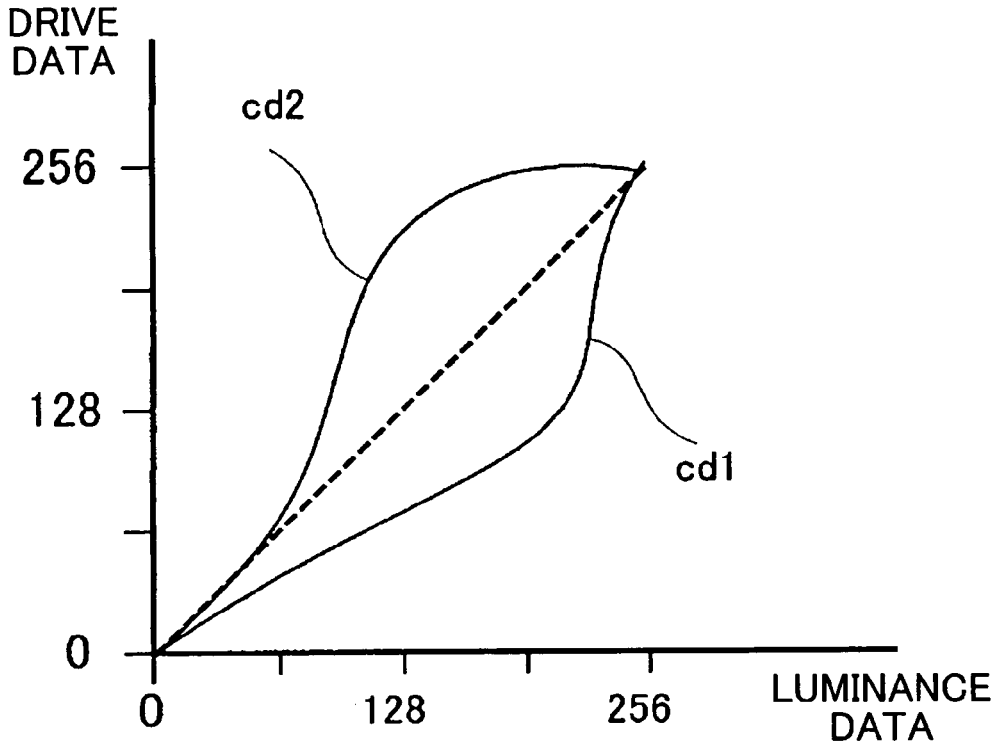
FIG. 16 is a graph showing the characteristic of a gradation converter which eliminates the characteristic of the PCLK of the sixth embodiment.

If the gradation conversion is not needed because the frequency deviation is small, it is permissible to skip the gradation conversion with the aforementioned switch. Further, it is permissible to select a frequency modulation condition of the PCLK generating portion through a controller (not shown) and write the gradation conversion table for each row into the table of the gradation converter 1040 from a low-speed memory of the controller so as to change the gradation conversion table (in this case, preferably, the table memory is a RAM). The gradation converter 1040 indicates the characteristic shown in FIG. 16 and converts the characteristic of cd1 to the luminance data of the row m to output drive data. Next, it converts the characteristic of cd2 to the luminance data of the row m+1 so as to output the drive data. In this way, the conversions for all the rows are carried out. As described above, as a result of the conversion, a gradation conversion table is so constructed that the difference of adjacent luminances is less than that of a single gradation or a difference in luminance from a case where the pulse width modulation is carried out with the source clock is less than that of a single gradation. The gradation conversion table is preferred to be constructed based on luminance tolerable values as shown in the third embodiment. Further, the gradation conversion table is preferred to be constructed so that the average luminance of plural frames is less than a luminance tolerable value as indicated in the fifth embodiment.

As described above, according to the sixth embodiment, the frequency deviation of the PCLK of the first embodiment to the third embodiment can be increased further without deterioration in image quality thereby the unnecessary radiation being reduced.

The present invention eliminates the necessity of a member having a high electric conductivity which is conventionally necessary for reducing the unnecessary radiation and does not sacrifice the optical characteristic of an image display unit and a ferrite core which is attached between an output of the modulator (driver) and a modulation wiring for removing harmonics components. That is, the reduction of the unnecessary ration can be achieved at a low cost.

(Other Embodiments)

Hereinafter, other example of the modulation method of the present invention will be described. According to the above described respective embodiments, only the pulse width is modulated depending on luminance data and the voltage amplitude and current amplitude of a modulation signal are not changed. The modulation method which will be described below is multiple value PWM modulation method in which the voltage amplitude and current amplitude are modulated while the pulse width is modulated depending on luminance data.

Figure 17:
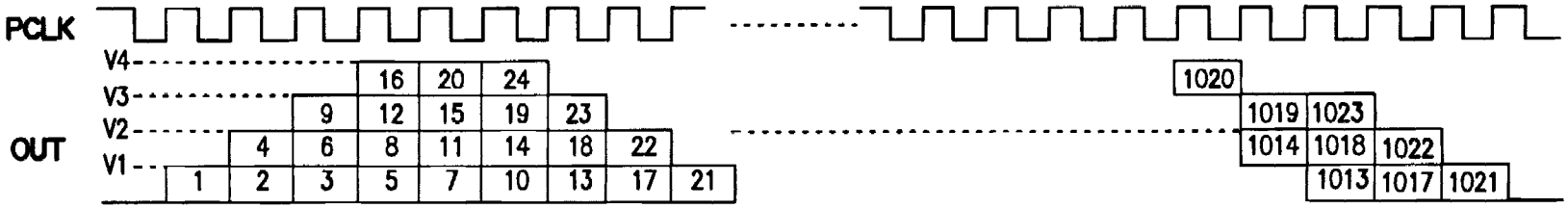
FIG. 17 is a diagram showing an example of the PCLK used for the present invention.

FIG. 17 shows a modulation clock (PCLK) and modulation signal waveform of the multi-value PWM modulation method. According to the modulation method shown in FIG. 17, the amplitude direction is enlarged depending on luminance data and when this enlargement is made impossible, time slot in the time direction is increased.

A number (1–1023) in a rectangle of the modulation signal waveform (OUT) means luminance data. If for example, luminance data is "12", the modulation signal waveform is constituted of rectangles in which numbers below "12" are written. Respective slots indicated by rectangles showing gradations are determined synchronously with a rise-up waveform of the PCLK which is a reference clock.

Such modulation signal waveform control is generally a pulse width control in the unit of slot width which is determined corresponding to the frequency of the reference clock. The crest value of each slot is controlled on at least n grades A1–An (n is an integer of 2 or more and 0<A1<A2<. . . An) and a waveform to be controlled is constituted of a leading portion which rises up to a predetermined crest value Ak (k is an integer of 2 or more) after passing by each slot in order from a crest value A1 to a crest value Ak−1 and a falling portion which falls by passing by each slot in order from the predetermined crest value Ak to the aforementioned crest value Ak−1 up to a crest value A1. Here, the modulation signal is a voltage waveform and this voltage is constituted of crest values of four grades V1–V4 with respect to GND which is a reference potential.

Because the modulation waveform is determined synchronously with the modulation clock (PCLK) as shown in FIG. 17, harmonics of the modulation clock (PCLK) occurs like the pulse width modulation.

Even the waveform shown in FIG. 17 can reduce the harmonics of the modulation clock (PCLK) according to the above-described method.

Figure 18:
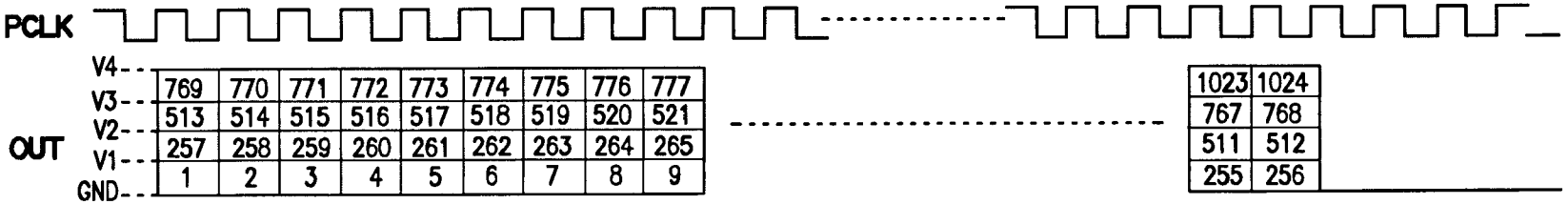
FIG. 18 is a diagram showing an example of the PCLK used for the present invention.

Next, FIG. 18 shows the PCLK and the modulation signal waveform (OUT) according to still other example of the multi-value PWM modulation method of the present invention. According to the modulation method shown in FIG. 18, the luminance data range is divided depending on each amplitude value and in each divided luminance data range, the pulse width modulation is carried out based on a corresponding specific value. In other words, the time direction is enlarged depending on luminance data and when this enlargement is made impossible, the amplitude direction is increased.

Because the modulation waveform is determined synchronously with the modulation clock (PCLK) as shown in FIG. 18, harmonics of the modulation clock (PCLK) occurs like the pulse width modulation.

Even the waveform shown in FIG. 18 can reduce harmonics of the modulation clock (PCLX) according to the above-described method.

A number (1–1024) in a rectangle of the modulation signal waveform means luminance data. If for example, luminance data is "9", the modulation signal waveform is constituted of rectangles in which numbers below "9" are written. Respective slots indicated by rectangles showing gradations are determined synchronously with a rise-up waveform of the PCLK which is a reference clock.

According to such modulation signal control, generally, the reference clock is counted and the pulse width control is carried out in the unit of slot width Δt according to the count value and luminance data and the crest value in each slot is controlled on at least n grades A1–An (n is an integer of 2 or more and 0<A1<A2<. . . An). Then, a waveform having increased gradations to a predetermined waveform of a modulation signal turns a unit block determined by a difference in crest value between the crest values An–1n–1, or A2–A1 or A1 and a crest value, which is a driving threshold of a light emission device, and a slot width Δt into a waveform having a configuration in which the maximum crest value Ak containing k=1 is lower and the maximum crest value is attached to continuous positions with priority. Here, the modulation signal is a voltage waveform and this voltage is constituted of four stages of crest values V1–V4 to the reference potential GND.

Figure 19:
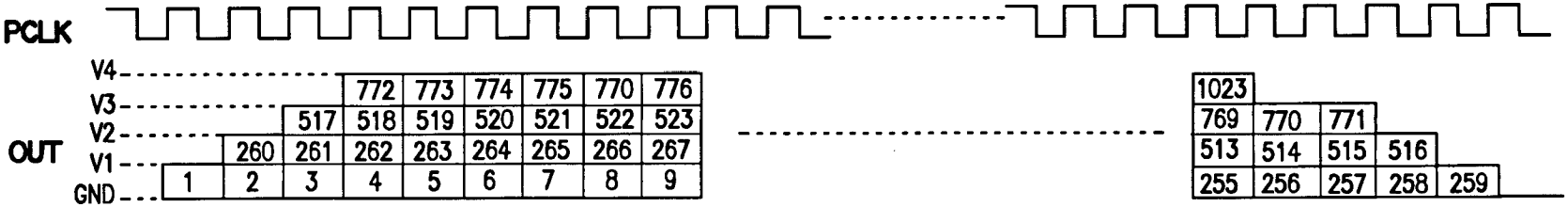
FIG. 19 is a diagram showing an example of the PCLK used for the present invention.

The waveform shown in FIG. 19 is based on a modulation method in which the time direction is increased depending on luminance data and when the enlargement is made impossible, the amplitude direction is increased. Further, this is a method for smoothing the leading and falling waveforms for countermeasures for ringing.

As regards the control on the modulation signal, generally, the reference clock is counted and the pulse width is controlled in the unit of a slot width Δt according to count value and luminance data. The crest value of each slot is controlled on at least n grades A1–An (n is an integer of 2 or more and 0<A1<A2<. . . An). The waveform whose gradations are increased with respect to a predetermined waveform of the modulation signal is controlled into a waveform having a configuration in which a unit waveform determined by a difference in crest value between crest values An–An–1, . . . A2–A1 or a crest value A1 and the crest value which is a drive threshold of a light emission device and a slot width Δt is attached to a position in which the maximum crest values Ak containing k=1 is lower and the maximum crest values are continuous. Here, the modulation signal is a voltage waveform and this voltage is constituted of crest values on four grades V1–V4 with respect to the reference voltage GND.

Because the modulation waveform is determined synchronously with the modulation clock (PCLK) as shown in FIG. 19, harmonics of the modulation clock (PCLK) is generated like the pulse width modulation.

Even the waveform shown in FIG. 19 can reduce harmonics of the modulation clock (PCLK) according to the above-described method. Such a modulation method has been disclosed in EP 1,267,319.

As the display panel used for the present invention, the matrix panel using a surface conduction electron-emitting device has been described. The present invention can be applied to such a display panel as FED (a display using SPINDT or MIM type emission device or field emission cold cathode device of type in which carbon fiber such as CNT, GNF is used as electron emitting substance), EL display, LED display as long as it has a large area matrix panel.

According to the above-described respective embodiments, all the modulators of the column wiring are supplied with a common modulation clock (PCLK) and by changing the frequency depending on time, the harmonics of the modulation clock (PCLK) is reduced. The present invention is not restricted to this example, but it is permissible to use plural modulation clocks (PCLK) frequency-modulated, which are controlled 50 as to have a different phase for each driver IC unit block of the drive circuit 7 or column wiring unit. In this case, the tolerable value of the difference in luminance between adjacent rows is determined for each block or each row and preferably, the frequency deviation of the plural PCLKs is limited so as to fall under the tolerable value.

According to the first embodiment, the tolerable value is determined to be a difference in luminance between adjacent luminance data (difference in luminance equal to a single gradation). Then, the frequency deviation of the PCLK is limited so that a difference of its display luminance to any luminance data obtained by a modulation clock corresponding to adjacent row wiring is below the tolerable value.

According to the second embodiment also, the tolerable value is determined to be a difference in luminance (difference in luminance equal to a single gradation) between adjacent luminance data in the display luminance obtained (or may be obtained) when the pulse width modulation is carried out with a source clock. Then, the frequency deviation of the PCLK is so limited that a difference in luminance between the display luminance obtained (or which may be obtained) when the pulse width modulation is carried out synchronously with a source clock of a specified frequency and the display luminance obtained when the pulse width modulation is carried out synchronously with the modulation clock (PCLK) frequency-modulated is below the tolerable value.

According to the present invention, the tolerable value does not need to be limited to the aforementioned value because the human discrimination capacity is 1–3% in terms of the difference in luminance. Preferably, the jitter amount of the modulation clock (PCLK) is limited so that the difference in display luminance between pixels of adjacent rows is less than 3% in the first-third embodiments.

Further, in a display apparatus for special application in which harmonics caused by the modulation clock (PCLK) is demanded to be suppressed depending on image quality, it is permissible to reduce the harmonics of the modulation clock (PCLK) by expanding the tolerable value to such an extent that an image can be recognized. In this case, a number of gradations (difference in display luminance) equal to 10% total number of gradations of image data, that is, 10% peak luminance should be selected as a tolerable value.

EXAMPLE

The basic structure and drive control method of the image display unit having a matrix panel which will be described in detail below are the same as the first embodiment.

Figure 20:
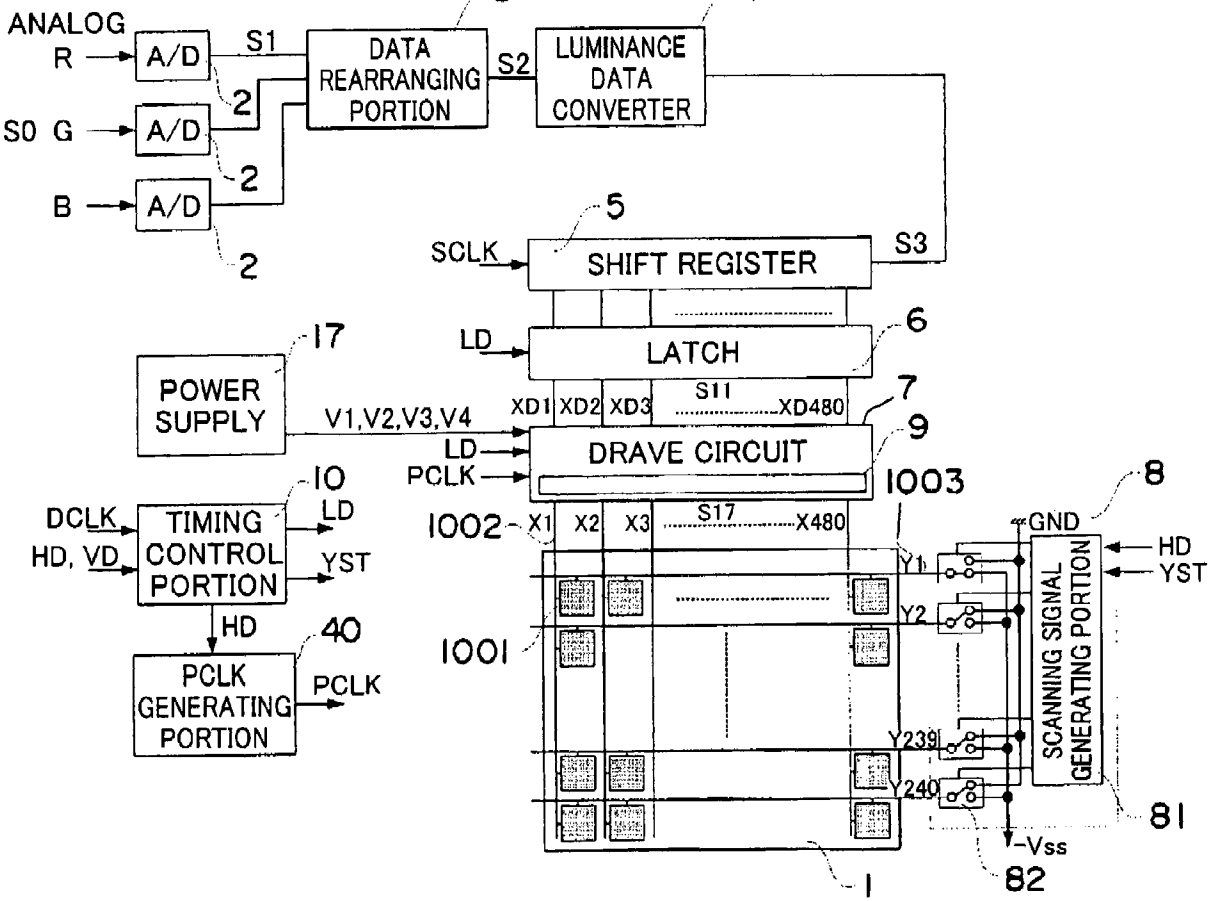
FIG. 20 is a structure diagram for explaining the driving unit for the matrix panel of the embodiment of the present invention.

As shown in FIG. 20, the matrix panel 1 comprises plural electron sources on a substrate, for example, multi-electron sources constituted of, for example, cold cathode devices 1001 and image formation members such as fluorescent materials for forming an image by irradiating with electrons. The cold cathode devices 1001 constituting a pixel are arranged near each intersection of the row wiring 1002 and column wiring 1003 and connected to the both wires.

The cold cathode device 1001 enables plural pieces thereof to be disposed at each minute interval because they can be positioned precisely on the substrate and formed if for example, manufacturing technology such as photolithography etching is employed. Further, because the cathode tube and its surrounding portion can be driven at a relatively low temperature as compared to a hot cathode used conventionally for the CRT and the like, multi-electron sources disposed at further minute arrangement pitch can be achieved.

As a cold cathode device, the surface conduction electron-emitting device, which disclosed in JP-A No. 10-039825 and the like, is preferably used.

Figure 22:
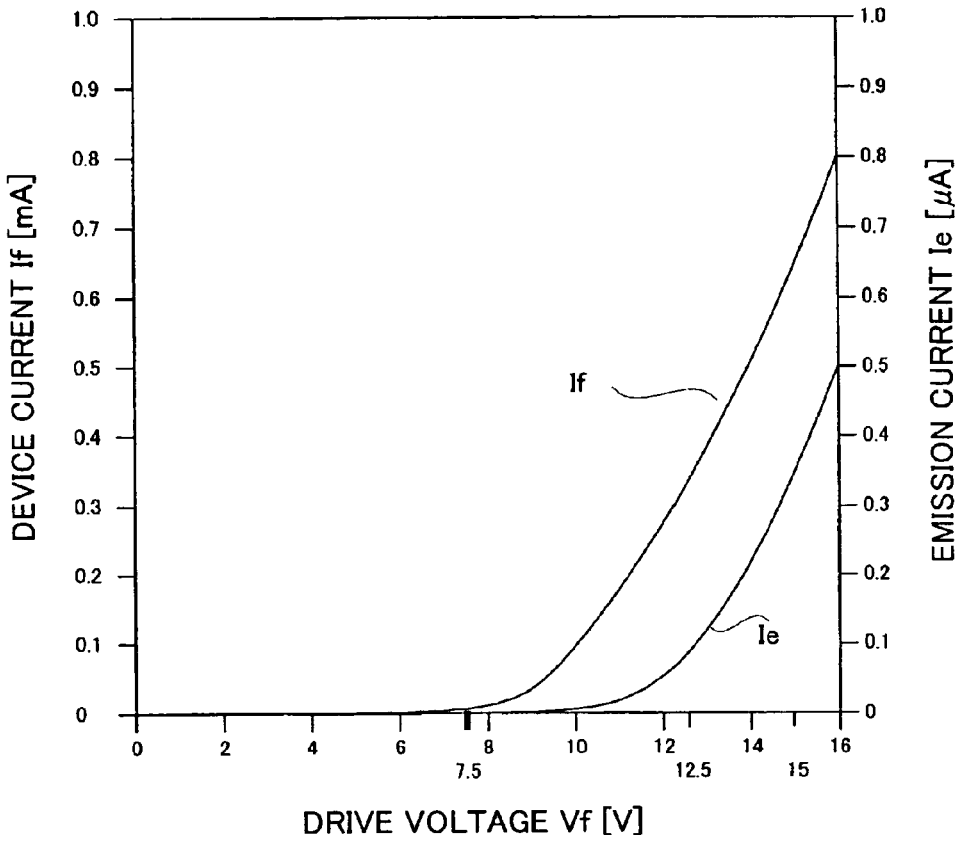
FIG. 22 is a graph showing an example of the relationship among device voltage Vf, device current If and emission current Ie of a surface conduction electron-emitting device used in the present invention.

FIG. 22 shows an example of the relation among a device voltage Vf, device current If, and emission current Ie of the surface conduction electron-emitting device. In FIG. 22, its abscissa axis indicates the device voltage Vf of the surface conduction electron-emitting device and its ordinate axis indicates a device current If and an emission current Ie. As evident from FIG. 22, a threshold voltage (about 7.5V) exists in the emission current Ie and no emission current Ie flows if the voltage is below the threshold voltage. At voltages above that, the emission current Ie flows corresponding to a device voltage. A simple matrix drive is enabled by using this characteristic.

In FIG. 20, the matrix panel 1 has multi-electron sources constituted of cold cathode devices 1001 disposed on a substrate in a thin vacuum container. As shown in FIG. 20, 3840 devices, that is, 1280 pixels (RGB)×3 are disposed in a horizontal direction and 720 devices are disposed in a vertical direction of the matrix panel 1. Because the quantities of the devices are determined depending on application of a product as required, it is not restricted to this example. The matrix panel 1 has a RGB stripe arranged pixels, for example.

The analog digital converter (A/D converter) 2 converts analog RGB component signal (called SO) decoded by the RGB signal of for example, a 720P image by an MPEG decoder2 (not shown) to digital RGB signals S1 each having a 8-bit width.

A data rearranging portion 3 has a function of inputting digital RGB signal (S1) of the A/D converter 2, rearranging digital data of each color corresponding to pixel arrangement of the matrix panel 1 and outputting an image data S2.

An luminance data converter 4 is a conversion table for converting an inputted image data S2 to luminance data of a desired luminance characteristic. The luminance data converter 4 converts to luminance data S3 by inverting a gamma-compensated signal for CRT as the characteristic of display system. The order of the processing of the data rearranging portion 3 and that of the luminance data converter 4 may be inverted.

A shift register 5 shift-transfers 10-bit wide luminance data S3 outputted from the luminance data converter 4 successively in matching with shift clock SCLK, for example, 36.8 MHz and outputs luminance data corresponding to each device of the matrix panel in parallel.

A latch circuit 6 latches luminance data from the shift register 5 with a load signal LD synchronous with a horizontal synchronous signal and holds it until a next load signal LD is inputted.

A column driving circuit outputs a modulation signal waveform indicated in the seventh embodiment. The column driving circuit 7 has a modulator 9 for generating a modulation signal of a pulse width corresponding to the luminance data synchronously with a modulation clock, which will be described later, and the modulation signal is supplied from this modulator 9 directly to column wiring on the matrix panel 1 through an output buffer so as to drive all column wiring.

A power circuit 17 supplies a modulation reference voltage (V1, V2, V3, V4, and GND) to the column driving circuit 7.

A scanning driver 8 as a row selecting circuit is connected to row wiring 1003 of the matrix panel 1. A scanning signal generating portion 81 shifts YST signal synchronous with a vertical synchronizing signal VD of input image signal successively according to a signal HD determined by a timing control portion 10 and outputs a selection/non-selection signal in parallel corresponding to the quantity of the row wiring. A switch means 82 constituted of an MOS transistor and the like is changed over depending on the output level of the selection/non-selection signal from the scanning signal generating portion 81 so as to output a selection potential (−Vss) and non-selection potential (GND).

The timing control portion 10 creates a desired timing control signal with synchronizing signals HD, VD of an input signal and data sampling clock DCLK and the like and outputs to each function block. Further, the timing control portion 10 outputs a load signal LD for the driving circuit 7 upon displaying according to an output S3 of the luminance data converter 4, and HD signal and YST signal which determine the row selecting time of the scanning driver 8.

A modulation clock (PCLK) generating portion 40 for generating a modulation clock for modulation frequency-modulates the source clock of for example, 13.65 MHz under the above-described condition so as to obtain the modulation clock (PCLK). The modulation clock generating portion 40 may generate the modulation clock (PCLK) according to a well-known method or may realize this purpose by changing over the outputs of plural clocks. However, needless to say, the condition about the tolerable values indicated in the above-described embodiment needs to be satisfied.

Figure 21:
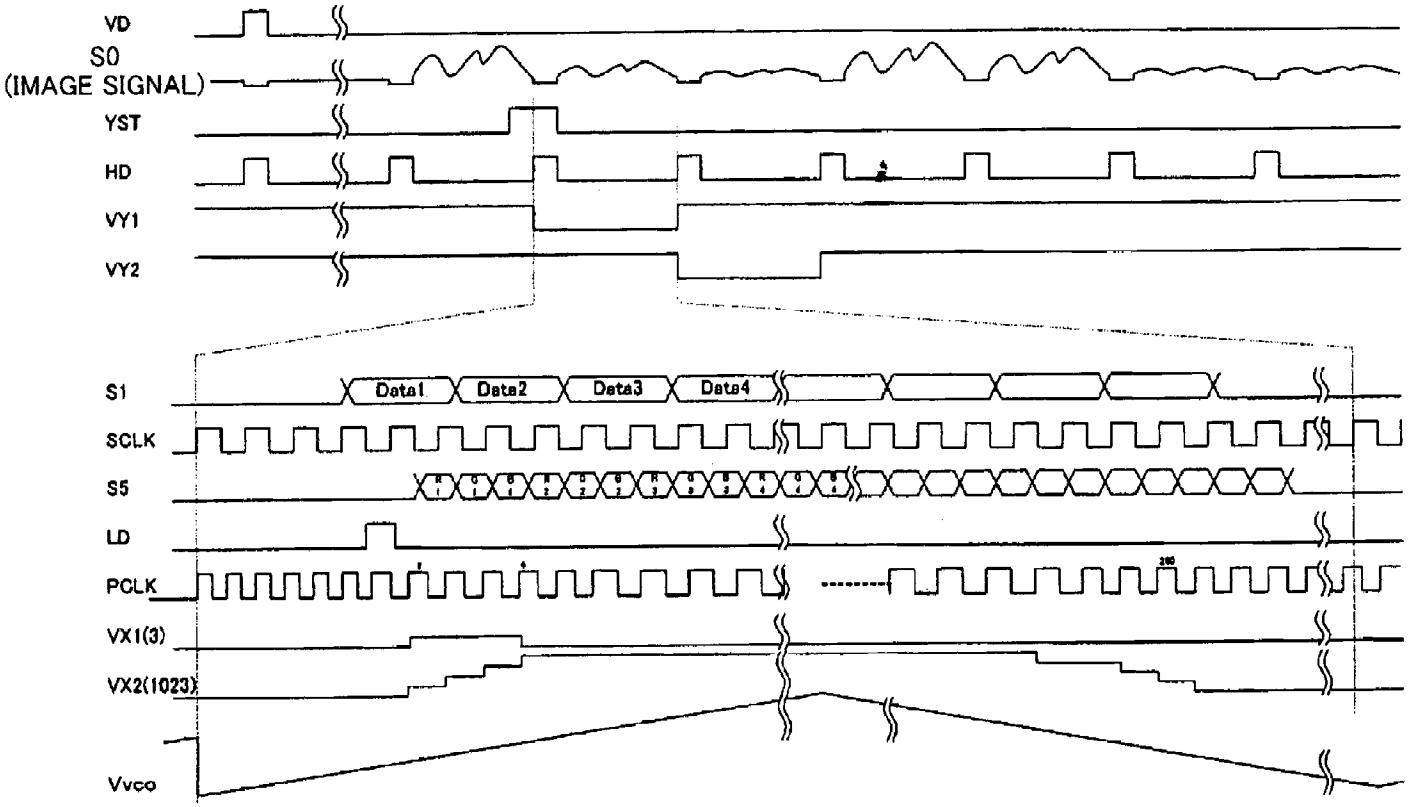
FIG. 21 is a timing diagram for explaining the driving unit for the matrix panel of the embodiment of the present invention.

FIG. 21 is a timing chart for explaining the drive control method for the matrix panel shown in FIG. 20.

Referring to FIG. 21, the A/D converter 2 converts an analog RGB component signal S0 decoded to a RGB signal of, for example, 720P image by a MPEG2 decoder (not shown) to digital RGB signal S1 of, for example, 8-bit width. Although not shown, it is preferable that a sampling clock DCLK is generated based on the synchronizing signal. The data rearranging portion 3 inputs the digital RGB signal S1 which is an output of the A/D converter 2. At this time, the processing is facilitated if the number of data on a single scanning line (1H) is determined depending on the number of pixels on the column wiring side of the matrix panel 1. According to this embodiment, the number of pixels on the column wiring side of the matrix panel 1 is determined to be 1280. The digital RGB signal S1 which is the output of the A/D converter 2 is outputted synchronous with data sampling clock DCLK (not shown).

As for the input signal 51 of the data rearranging portion 3, the PGB parallel signal S0 is changed over at a timing of a clock (SCLK) (not shown) which is a clock having a frequency three times the data sampling clock DCLK and outputted successively following the RGB pixel arrangement of the matrix panel 1.

Figure 23:
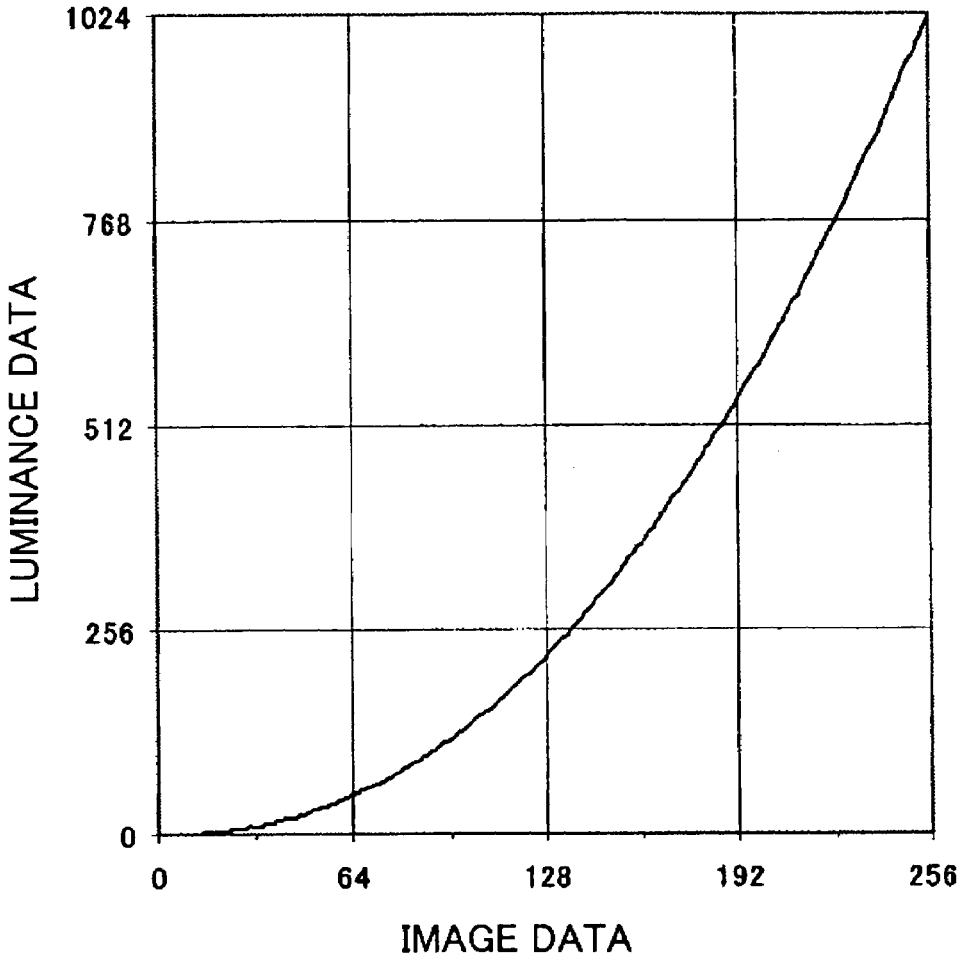
FIG. 23 is a graph for explaining the characteristic of an luminance data converter of the driving unit for the matrix panel according to the embodiment of the present invention.

The output signal 32 of the data rearranging portion 3 is inputted to the luminance data converter 4. The luminance data converter 4 converts, for example, 8-bit wide output signal S2 of the data rearranging portion to 10-bit wide luminance data S3 by means of a conversion table ROM which stores desired data, so that the characteristic of the display system turns to the same luminance characteristic as the gamma characteristic of the CRT. As the characteristic of the conversion table, the characteristic of raising to the 2.2 power, for example, the characteristic shown in FIG. 23 is used.

As shown in FIG. 20, the luminance data S3 which is an output of the luminance data converter 4 is outputted to the shift register 5. The luminance data S3 transferred to the shift register 5 is shift-transferred successively according to the shift clock SCLK so that 10-bit luminance data corresponding to each device of the matrix panel 1 is serial-parallel converted and outputted.

Then, the latch 6 latches luminance data which is serial-parallel converted at a rise up of a load signal LD synchronous with the HD signal and holds data until next load signal LD is inputted and outputs.

Although the transfer clock supplying circuit for supplying the shift clock SCLK synchronous with the luminance data is not shown here, the shift clock SCLK may be created by multiplying data sampling clock DCLK up to three times gradually with PLL or the like. The shift clock SCLK is called transfer clock also because it is a clock for transferring data. As described above, preferably, the transfer clock is generated synchronously with the data-sampling clock DCLK and different from the modulation clock frequency-modulated.

With reference to the time of the load signal LD, the driving circuit 7 outputs a modulation signal determined by the luminance data to column wiring X1–X384 synchronously with the modulation clock (PCLK) so as to drive the matrix panel 1. The numbers in the parentheses of VX1(3)–VX2(1023) indicate an example of the luminance data.

The scanning line driver 8 drives the row wiring by transferring signals for determining the scanning startup time, or signals YST synchronous with the vertical synchronizing signal VD of the input image signal shown in FIG. 21 successively and synchronously with the HD. Then, the respective row wirings are scanned successively so as to form an image.

According to this embodiment, the scanning driver 8 drives the row wiring from the first (Y1) to the 720 (Y720) successively with a selection voltage −Vss (for example, −7.5 V) and synchronously with the HD. At this time, the scanning driver 8 holds the voltages of other row wiring not selected at a value selected from the non-selection voltages 0V–+8.5V and drives them (see VY1, VY2).

The emission current Ie flows to the cold cathode device 1001 of a column to which a modulation signal (drive signal) is outputted by the driving circuit 7 through a row wiring selected by the scanning driver 8. On the other hand, no device current If flows to a device corresponding to a column wiring to which no drive signal is outputted by the driving circuit 7 and no emission current Ie flows and consequently, pixels corresponding to these devices do not emit light. The scanning driver drives the row wiring from the $1^{st}$ to the $720^{th}$ with a selection voltage synchronously with the HD and the driving circuit 7 drives corresponding column wiring according to the driving signals S17 corresponding to luminance data so as to form an image.

Preferably, the scanning driver 8 operates to select two or more row wiring at the same time in order to improve luminance.

Figure 24:
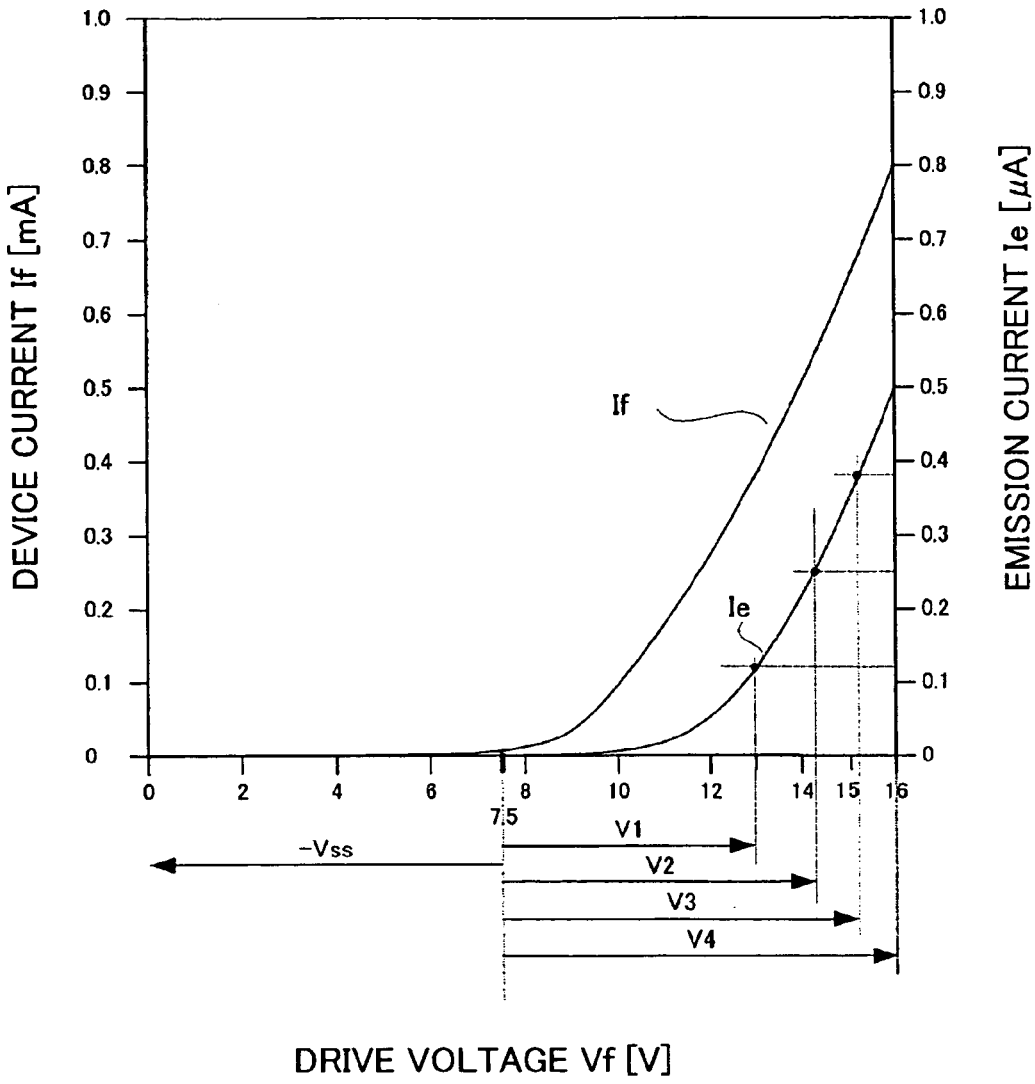
FIG. 24 is a graph for explaining a set value of modulation reference voltage.

Next, the modulation reference voltage will be described. The modulation reference voltage (V1, V2, V3, V4, and GND) is set as shown in FIG. 24. That is, V3 is determined so as to be an emission current ¾ a emission current emitted at voltages +Vs +V4. Likewise, V2 is determined to be ⅔ emission current. Likewise, V1 is determined to be ¼ emission current. As a result, in the modulation signal waveform (drive waveform) of FIG. 19, its luminance can obtain substantially linear characteristic to the luminance data.

Actual modulation clock (PCLK) is determined as follows.

A frame time includes 750 horizontal periods including a blanking period and respective row wirings are selected successively in that time. If a time necessary for changeover of the row wiring is determined to be 10%, the maximum time for the modulation signal is 90% the horizontal period. The modulation signal waveform shown in FIG. 19 needs 259 PCLKs in order to modulate luminance data of 1023 gradations.

The frequency (fPCLK) of actual modulation clock (PCLK) is $fPCLK=60\times750\times259/0.9\approx13$ MHz (expression 28).

The EMI is measured without modulating the modulation clock (PCLK). As a result, the harmonics of PCLK is frequency of 100 to 500 MHz, and about 10 to 20 dB larger than the base level.

According to this embodiment, the PCLK is created with a voltage control oscillator and the control voltage of the voltage control oscillator is a triangular wave synchronized by the HD signal. The central frequency of the voltage control oscillator is set to about 13.65 MHz and the frequency deviation is set to 3%. The number of the PCLKs which is 90% the horizontal period is set to 259 clocks. As a result, harmonics of 104 MHz which is the $8^{th}$ harmonics can be lowered by 14 dB, so that it can be lowered to substantially base level.

Figure 25:
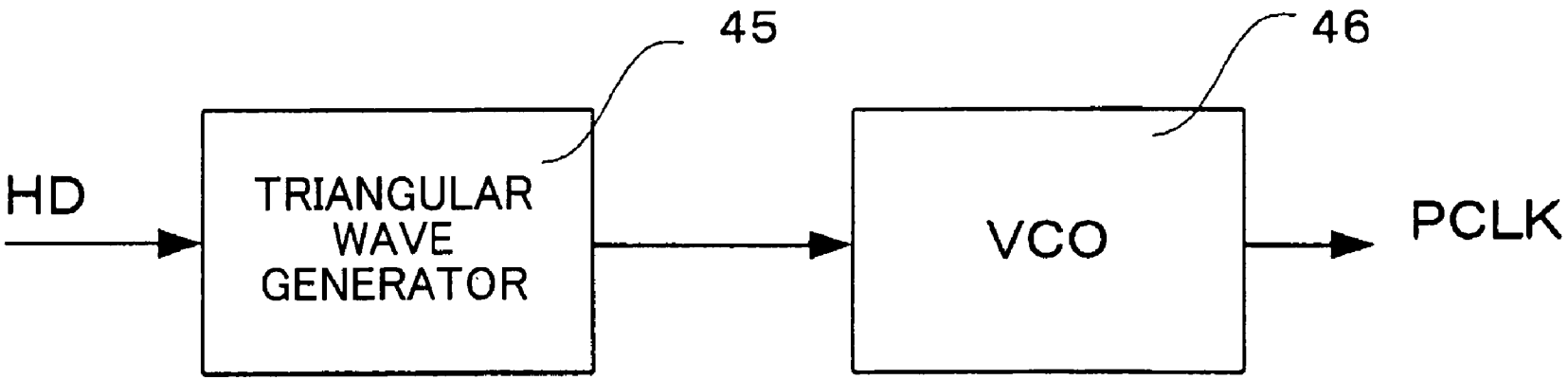
FIG. 25 is a structure diagram for explaining the PCLK generating portion of the drive unit for the matrix panel according to the embodiment of the present invention.
Figure 26:
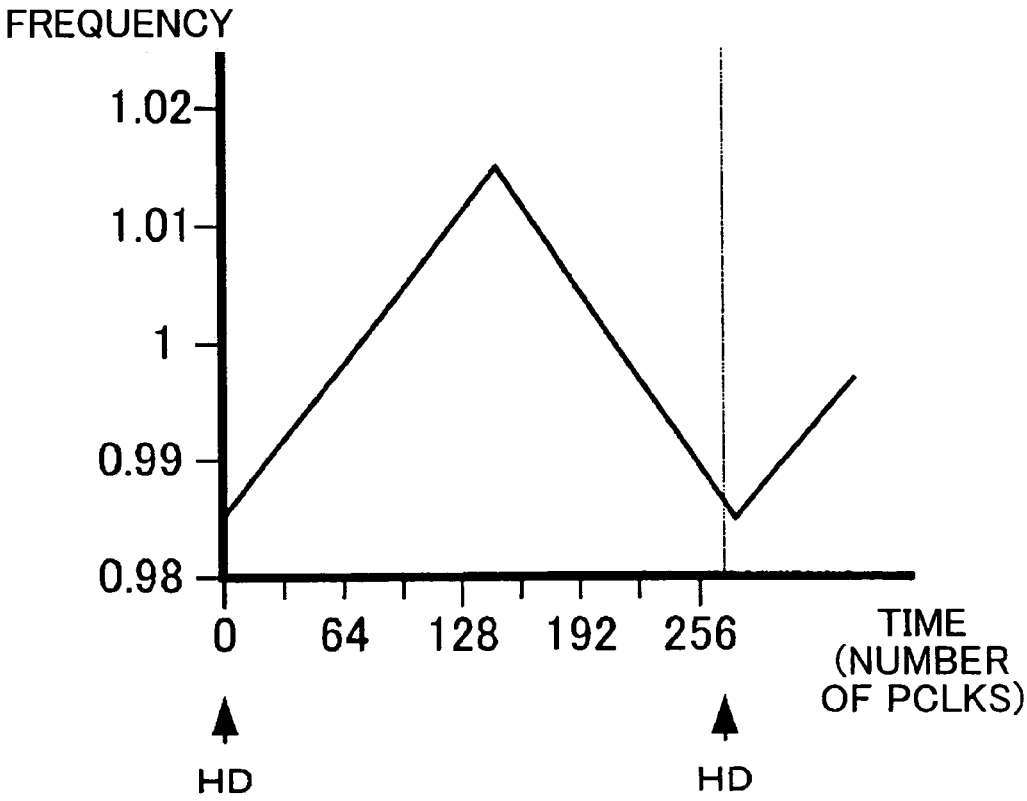
FIG. 26 is a graph showing the frequency of the PCLK of the driving unit for the matrix panel according to the embodiment of the present invention.

FIG. 25 shows an example of the structure of the modulation clock (PCLK) generating portion 40. FIG. 26 shows an example of the frequency of the PCLK outputted by the voltage control oscillator 46.

Referring to FIG. 25, reference numeral 45 denotes a triangular wave generator and reference numeral 46 denotes a voltage control oscillator (VCO). The cycle of the triangular wave generator 45 is designed to have substantially the same cycle of the HD signal as shown in FIG. 26. More specifically, this can be realized by an oscillator using a crystal oscillator, a counter, a D/A converter and the like. The oscillation frequency of the crystal oscillator can be realized at a low cost if the HD signal (synchronous with an input image signal) is oscillated without phase lock. The voltage control oscillator 46 outputs a modulation clock (PCLX) of a frequency (cycle) following the output potential of the triangular wave generator 45.

Because the modulation clock (PCLK) is not synchronous with the HD signal, the frequency is slightly different to the same number of the PCLKs in a next row selection time. However, the tolerable value between adjacent rows indicated in the first embodiment is a sufficient small value thereby hardly causing deterioration in image quality.

Although the triangular wave created by the triangular wave generator 45 is inputted to the voltage control oscillator 46, the potential waveform to be inputted to the voltage control oscillator 46 is desired to be sine wave rather than the triangular wave, so that there exists no point of the PCLK number in which differential values of the cycle are not continuous.

If the modulation clock is not modulated, the EMI is changed depending on the case and the constant number of a matrix panel (size, capacity between wires and the like). Thus, a necessary frequency deviation may be determined depending on the magnitude of actual unnecessary radiation. If a low frequency deviation is permitted, the first embodiment, the second embodiment and third embodiment are effective, and if the frequency deviation needs to be increased because the EMI is high, the sixth embodiment is effective.

The present invention enables the EMI countermeasure to be taken without using an expensive ferrite core and a low resistance transparent plate, which are conventionally employed. For example, a configuration which clears the VCCI class B or the like can be achieved at a low cost.

As described above, the unnecessary ration can be reduced without deterioration in image quality by determining the modulation signal waveform based on the PCLK frequency-modulated like the seventh embodiment.

What is claimed is:

1. A drive control apparatus for a display panel comprising:

a drive circuit for supplying a modulation signal to a modulation wiring of the display panel, having a modulator for generating the modulation signal in which at least a pulse width thereof is modulated based on inputted luminance data;

a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, the modulation clock supplying circuit supplies the modulation clock which has a frequency deviation to spread harmonics spectrum as compared to a virtual source clock of a constant frequency, and the frequency deviation is so restricted that, if at least two pixels corresponding to two adjacent scanning wirings are displayed based on arbitrary same luminance data, a difference between a display luminance of one pixel in a specified period and a display luminance of the other pixel in the specified period is less than or equal to a tolerable value determined by the luminance data.

2. A drive control apparatus for a display panel according to claim 1, wherein the display luminance of the specified period is a luminance in a single frame period or an average luminance of two or more frame periods.

3. A drive control apparatus for a display panel according to claim 1, wherein a phase of the modulation clock is changed in synchronization with a selection period of the scanning wiring.

4. A drive control apparatus for a display panel according to claim 3, wherein the modulation clock is so constructed that differential values of its cycles are continuous.

5. A drive control apparatus for a display panel according to claim 1, wherein the tolerable value is 10% the maximum display luminance.

6. A drive control apparatus for a display panel according to claim 1, wherein when the display luminance in the specified period of the one pixel is La, the display luminance in the specified period of the other pixel is Lb and the difference in luminance is $|La-Lb|$, the tolerable value is 0.015 (La+Lb).

7. A drive control apparatus for a display panel according to claim 1, wherein the tolerable value is a difference between display luminances displayed based on the luminance data of adjacent two levels.

8. A drive control apparatus for a display panel according to claim 1, wherein the tolerable value is small when the luminance data is small and large when the luminance data is large.

9. A drive control apparatus for a display panel according to claim 1, wherein the tolerable value is a quantity proportional to the power of the luminance data.

10. A drive control apparatus for a display panel comprising:

a drive circuit for supplying a modulation signal to a modulation wiring of the display panel, having a modulator for generating the modulation signal in which at least a pulse width thereof is modulated based on inputted luminance data;

a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, the modulation clock supplying circuit supplies the modulation clock which has a frequency deviation to spread harmonics spectrum as compared to a virtual source clock of a constant frequency, and the frequency deviation is so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data.

11. A drive control apparatus for a display panel according to claim 10, wherein the display luminance of the specified period is a luminance in a single frame period or an average luminance of two or more frame periods.

12. A drive control apparatus for a display panel according to claim 10, wherein a phase of the modulation clock is changed in synchronization with a selection period of the scanning wiring.

13. A drive control apparatus for a display panel according to claim 12, wherein the modulation clock is so constructed that differential values of its cycles are continuous.

14. A drive control apparatus for a display panel according to claim 10, wherein the tolerable value is 10% the maximum display luminance.

15. A drive control apparatus for a display panel according to claim 10, wherein the tolerable value is a difference between display luminances displayed based on the luminance data of adjacent two levels.

16. A drive control apparatus for a display panel according to claim 10, wherein the tolerable value is small when the luminance data is small and large when the luminance data is large.

17. A drive control apparatus for a display panel according to claim 10, wherein the tolerable value is a quantity proportional to the power of the luminance data.

18. A drive control apparatus for a display panel comprising:

a drive circuit for supplying a modulation signal to a modulation wiring of the display panel, having a modulator for generating the modulation signal in which at least a pulse width thereof is modulated based on inputted luminance data;

a selection circuit for selecting a scanning wiring of the display panel; and a modulation clock supplying circuit for supplying a modulation clock serving as a criterion for determining the pulse width of the modulation signal to the modulator, wherein the modulator modulates the pulse width of the modulation signal in synchronization with the modulation clock, and the modulation clock supplying circuit supplies the modulation clock which has a frequency deviation to spread harmonics spectrum as compared to a virtual source clock of a constant frequency and includes a gradation converter for converting a gradation of the luminance data in order to compensate for changes in a display luminance level due to the frequency deviation.

19. A drive control apparatus for a display panel according to claim 18, wherein the frequency deviation is so restricted that, if at least two pixels corresponding to two adjacent scanning wirings are displayed based on arbitrary same luminance data, a difference between a display luminance of one pixel in a specified period and a display luminance of the other pixel in the specified period is less than or equal to a tolerable value determined by the luminance data.

20. A drive control apparatus for a display panel according to claim 19, wherein the display luminance of the specified period is a luminance in a single frame period or an average luminance of two or more frame periods.

21. A drive control apparatus for a display panel according to claim 19, wherein the tolerable value is 10% the maximum display luminance.

22. A drive control apparatus for a display panel according to claim 19, wherein when the display luminance in the specified period of the one pixel is La, the display luminance in the specified period of the other pixel is Lb and the difference in luminance is $|La-Lb|$, the tolerable value is 0.015 (La+Lb).

23. A drive control apparatus for a display panel according to claim 19, wherein the tolerable value is a difference between display luminances displayed based on the luminance data of adjacent two levels.

24. A drive control apparatus for a display panel according to claim 19, wherein the tolerable value is small when the luminance data is small and large when the luminance data is large.

25. A drive control apparatus for a display panel according to claim 19, wherein the tolerable value is a quantity proportional to the power of the luminance data.

26. A drive control apparatus for a display panel according to claim 18, wherein the frequency deviation is so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data.

27. A drive control apparatus for a display panel according to claim 26, wherein the display luminance of the specified period is a luminance in a single frame period or an average luminance of two or more frame periods.

28. A drive control apparatus for a display panel according to claim 26, wherein the tolerable value is 10% the maximum display luminance.

29. A drive control apparatus for a display panel according to claim 26, wherein the tolerable value is a difference between display luminances displayed based on the luminance data of adjacent two levels.

30. A drive control apparatus for a display panel according to claim 26, wherein the tolerable value is small when the luminance data is small and large when the luminance data is large.

31. A drive control apparatus for a display panel according to claim 26, wherein the tolerable value is a quantity proportional to the power of the luminance data.

32. A drive control apparatus for a display panel according to claim 18, wherein a phase of the modulation clock is changed in synchronization with a selection period of the scanning wiring.

33. A drive control apparatus for a display panel according to claim 32, wherein the modulation clock is so constructed that differential values of its cycles are continuous.

34. A drive control method for a display panel comprising the steps of:

generating a modulation clock which serves as a criterion for determining a pulse width of a modulation signal and has a frequency deviation to spread harmonics spectrum as compared to a virtual source clock of a constant frequency, the frequency deviation being so restricted that, if at least two pixels corresponding to two adjacent scanning wirings are displayed based on arbitrary same luminance data, a difference between a display luminance of one pixel in a specified period and a display luminance of the other pixel in the specified period is less than or equal to a tolerable value determined by the luminance data;

generating a modulation signal by modulating at least a pulse width based on inputted luminance data in synchronization with the modulation clock;

selecting a scanning wiring of the display panel; and supplying the modulation signal to a modulation wiring of the display panel.

35. A drive control method for a display panel comprising the steps of:

generating a modulation clock which serves as a criterion for determining a pulse width of a modulation signal and has a frequency deviation to spread harmonics spectrum as compared to a virtual source clock of a constant frequency, the frequency deviation being so restricted that, if an arbitrary pixel is displayed based on arbitrary same luminance data, a difference between a display luminance in a specified period obtained by the virtual source clock and a display luminance in the specified period obtained by the modulation clock is less than or equal to a tolerable value determined by the luminance data;

generating a modulation signal by modulating at least a pulse width based on inputted luminance data in synchronization with the modulation clock;

selecting a scanning wiring of the display panel; and supplying the modulation signal to a modulation wiring of the display panel.

36. A drive control method for a display panel comprising the steps of:

generating a modulation clock which serves as a criterion for determining a pulse width of a modulation signal and has a frequency deviation to spread harmonics spectrum as compared to a virtual source clock of a constant frequency;

converting a gradation of luminance data in order to compensate for changes in a display luminance level due to the frequency deviation;

generating a modulation signal by modulating at least a pulse width based on inputted luminance data in synchronization with the modulation clock;

selecting a scanning wiring of the display panel; and supplying the modulation signal to a modulation wiring of the display panel.

* * * * *

UNITED STATES PATENT AND TRADEMARK OFFICE

CERTIFICATE OF CORRECTION

PATENT NO. : 7,154,489 B2
APPLICATION NO. : 10/767733
DATED : December 26, 2006
INVENTOR(S) : Naoto Abe et al.

It is certified that error appears in the above-identified patent and that said Letters Patent is hereby corrected as shown below:

ON THE TITLE PAGE:
At Item (57), Abstract, Line 11, "quality" should read --quality.--.

IN THE DRAWINGS:
Sheet No. 20, Figure 20, "DRAVE" should read --DRIVE--.

COLUMN 1:
Line 64, "other" should read --another--.
Line 66, "other" should read --another--.

COLUMN 3:
Line 62, "comprising" should read --comprising:--.

COLUMN 5:
Line 54, "based" should read --based on--.

COLUMN 6:
Line 12, "FIG. 12a-c" should read --FIGS. 12a-c--.
Line 45, "an" should read --a--.

COLUMN 7:
Line 47, "follow." should read --follows.--.
Line 67, "55" should read --5--.

COLUMN 8:
Line 32, "followed:" should read --follows:--.

COLUMN 9:
Line 43, "ration" should read --radiation--.
Line 67, "luminanced at a" should read --luminance data--.

COLUMN 10:
Line 17, "maybe" should read --may be--.

COLUMN 11:
Line 5, "PCLX" should read --PCLK--.

UNITED STATES PATENT AND TRADEMARK OFFICE

CERTIFICATE OF CORRECTION

PATENT NO. : 7,154,489 B2
APPLICATION NO. : 10/767733
DATED : December 26, 2006
INVENTOR(S) : Naoto Abe et al.

It is certified that error appears in the above-identified patent and that said Letters Patent is hereby corrected as shown below:

COLUMN 12:
Line 12, "(j=±0.01)" should read --(j=±0.01),--.
Line 21, "on" should read --to--.
Line 61, "in" should read --in the--.

COLUMN 13:
Line 17, "the-source" should read --the source--.
Line 50, "(n-1" should read --(n-1)--.

COLUMN 14:
Line 6, "deterioration" should read --is established, deterioration--.

COLUMN 15:
Line 8, "reduced" should read --reduced.--.

COLUMN 16:
Line 17, "66 n" should read --Δn--.
Line 37, "An" should read --Δn--.
Line 50, "L(m,N)," should read --L(m,n),--.

COLUMN 17:
Line 16, "(FCLK)" should read --(PCLK)--.
Line 34, "(25)" should read --(25):--.

COLUMN 18:
Line 1, "first," should read --first and--.
Line 46, "(S41)" should read --(S41).--.

COLUMN 19:
Line 34, "in" should read --in a--.

COLUMN 20:
Line 14, "To(m, n)" should read --To(m, n))--.
Line 30, "-third" should read --third--.
Line 38, "(.PCLK)" should read --(PCLK)--.
Line 44, "embodiment" should read --embodiments--.
Line 53, "embodiment" should read --embodiments--.

UNITED STATES PATENT AND TRADEMARK OFFICE

CERTIFICATE OF CORRECTION

PATENT NO. : 7,154,489 B2
APPLICATION NO. : 10/767733
DATED : December 26, 2006
INVENTOR(S) : Naoto Abe et al.

It is certified that error appears in the above-identified patent and that said Letters Patent is hereby corrected as shown below:

COLUMN 21:
Line 67, “ration” should read --radiation--.

COLUMN 22:
Line 2, “other” should read --another--.
Line 4, “above described” should read --above-described--.
Line 64, “(PCLX)” should read --(PCLK)--.

COLUMN 24:
Line 3, “50” should read --so--.

COLUMN 25:
Line 38, “An” should read --a--.

COLUMN 26:
Line 51, “51” should read --S1--.
Line 52, “PGB” should read --RGB--.

COLUMN 27:
Line 56, “wiring” should read --wirings--.
Line 61, “a” should read --an--.

COLUMN 28:
Line 43, “(PCLX)” should read --(PCLK)--.

UNITED STATES PATENT AND TRADEMARK OFFICE

CERTIFICATE OF CORRECTION

PATENT NO. : 7,154,489 B2
APPLICATION NO. : 10/767733
DATED : December 26, 2006
INVENTOR(S) : Naoto Abe et al.

It is certified that error appears in the above-identified patent and that said Letters Patent is hereby corrected as shown below:

COLUMN 29:
Line 6, "ration" should read --radiation--.

Signed and Sealed this

Twentieth Day of November, 2007

JON W. DUDAS
*Director of the United States Patent and Trademark Office*